US007312022B2

(12) United States Patent
Kiyoto et al.

(10) Patent No.: US 7,312,022 B2
(45) Date of Patent: Dec. 25, 2007

(54) METHOD OF FORMING COLOR IMAGE

(75) Inventors: Naoharu Kiyoto, Minami-Ashigara (JP); Junichiro Hosokawa, Minami-Ashigara (JP); Takanori Hioki, Minami-Ashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/001,510

(22) Filed: Dec. 2, 2004

(65) Prior Publication Data

US 2005/0130081 A1 Jun. 16, 2005

(30) Foreign Application Priority Data

Dec. 5, 2003 (JP) ..... 2003-407652

(51) Int. Cl.
*G03C 5/18* (2006.01)

(52) U.S. Cl. ..... 430/434; 430/435; 430/464; 430/467

(58) Field of Classification Search ..... 430/434, 430/435, 464, 467
See application file for complete search history.

(56) References Cited

U.S. PATENT DOCUMENTS 6,350,564 B1 * 2/2002 Bringley et al. ..... 430/502

2005/0069822 A1 * 3/2005 Hosokawa et al. ..... 430/448

* cited by examiner

*Primary Examiner*—Geraldina Visconti
(74) *Attorney, Agent, or Firm*—Sughrue Mion Pllc.

(57) ABSTRACT

A method of forming color image, comprising processing a silver halide color photosensitive material with a development processing solution containing a color developing agent, the silver halide color photosensitive material comprising a support and, superimposed thereon, a blue-sensitive layer unit composed of at least one silver halide emulsion layer, a green-sensitive layer unit composed of at least two silver halide emulsion layers, a red-sensitive layer unit composed of at least two silver halide emulsion layers and at least one non-light-sensitive layer, wherein the development processing solution or processing solution applied to the silver halide color photosensitive material before the use of the development processing solution contains compound (A), the compound (A) being a heterocyclic compound having three or more heteroatoms which when added, is capable of substantially enhancing the sensitivity of the silver halide color photosensitive material as compared with that exhibited when not added.

4 Claims, No Drawings

METHOD OF FORMING COLOR IMAGE

CROSS-REFERENCE TO RELATED APPLICATIONS

This application is based upon and claims the benefit of priority from prior Japanese Patent Application No. 2003-407652, filed Dec. 5, 2003, the entire contents of which are incorporated herein by reference.

BACKGROUND OF THE INVENTION

1. Field of the Invention

The present invention relates to a method of forming color image on a silver halide color photosensitive material. More particularly, the present invention relates to a method of forming color image that ensures high sensitivity, excellent storability and further excellent color image storability.

2. Description of the Related Art

In the field of silver halide color photosensitive material, it is a longstanding issue to attain sensitivity enhancement without detriment to graininess. Generally, the photographic speed is determined by the size of silver halide emulsion grains. The larger the emulsion grains, the greater the photographic speed. However, since the graininess would be deteriorated in accordance with an increase of silver halide grain size, the speed and the graininess are in a tradeoff relationship. In the art to which the invention pertains, attaining sensitivity enhancement without detriment to graininess is the most fundamental and important task in the upgrading of the image quality of photosensitive materials.

The technology for attaining sensitivity enhancement without detriment to graininess by incorporating a compound having at least three heteroatoms in a silver halide photosensitive material has been disclosed (see, for example, Jpn. Pat. Appln. KOKAI Publication No. (hereinafter referred to as JP-A-) 2000-194085 and JP-A-2003-156823).

However, although an sensitivity enhancement by the above technology can be recognized, the effect thereof is not satisfactory. Further, a new problem by the use of the above technology has surfaced. It has been found that with respect to the sensitive material obtained by the use of the above technology, the storability of raw sensitive material would be deteriorated.

BRIEF SUMMARY OF THE INVENTION

It is an object of the present invention to provide a method of attaining sensitivity enhancement without detriment to storability, graininess, etc. with respect to silver halide photosensitive materials.

The inventors have found that the above task can be attained by the use of the following compound (A).

Specifically, the present invention provides the following method.

(1) A method of forming color image, comprising processing a silver halide color photosensitive material with a development processing solution containing a color developing agent, the silver halide color photosensitive material comprising a support and, superimposed thereon, a blue-sensitive layer unit composed of at least one silver halide emulsion layer, a green-sensitive layer unit composed of at least two silver halide emulsion layers, a red-sensitive layer unit composed of at least two silver halide emulsion layers and at least one non-light-sensitive layer, wherein the development processing solution or processing solution applied to the silver halide color photosensitive material before the use of the development processing solution contains compound (A), the compound (A) being a heterocyclic compound having three or more heteroatoms which when added, is capable of substantially enhancing the sensitivity of the silver halide color photosensitive material as compared with that exhibited when not added.

(2) The method of forming color image according to item (1) above, wherein the compound (A) is contained in the development processing solution containing a color developing agent.

(3) The method of forming color image according to item (1) or (2) above, wherein the compound (A) is contained in the processing solution in a proportion of 0.0001 to 100 g/liter.

(4) The method of forming color image according to item (1) or (2) above, wherein the compound (A) is contained in the processing solution in a proportion of 0.001 to 20 g/liter.

DETAILED DESCRIPTION OF THE INVENTION

The heterocyclic compound having three or more heteroatoms, compound (A), will be described below.

In the present invention, when any specified moiety is referred to as "group", it is meant that the moiety per se may be unsubstituted or have one or more (up to possible largest number) substituents. For example, the "alkyl group" refers to a substituted or unsubstituted alkyl group. The substituents which can be employed in the compounds of the present invention are not limited irrespective of the existence of substitution.

When these substituents are referred to as W, the substituents represented by W are not particularly limited. As such, there can be mentioned, for example, halogen atoms, alkyl groups (including a cycloalkyl group, a bicycloalkyl group and a tricycloalkyl group), alkenyl groups (including a cycloalkenyl group and a bicycloalkenyl group), alkynyl groups, aryl groups, heterocyclic groups, a cyano group, a hydroxyl group, a nitro group, a carboxyl group, alkoxy groups, aryloxy groups, a silyloxy group, heterocyclic oxy groups, acyloxy groups, a carbamoyloxy group, alkoxycarbonyloxy groups, aryloxycarbonyloxy groups, amino groups (including alkylamino groups, arylamino groups and heterocyclic amino groups), an ammonio group, acylamino groups, an aminocarbonylamino group, alkoxycarbonylamino groups, aryloxycarbonylamino groups, a sulfamoylamino group, alkyl- or arylsulfonylamino group, a mercapto group, alkylthio groups, arylthio groups, heterocyclic thio groups, a sulfamoyl group, a sulfo group, alkyl- or arylsulfinyl groups, alkyl- or arylsulfonyl groups, acyl groups, aryloxycarbonyl groups, alkoxycarbonyl groups, a carbamoyl group, aryl- or heterocyclic azo groups, an imido group, a phosphino group, a phosphinyl group, a phosphinyloxy group, a phosphinylamino group, a phosphono group, a silyl group, a hydrazino group, a ureido group, a borate group ($—B(OH)_2$), a phosphato group ($—OPO(OH)_2$), a sulfato group ($—OSO_3H$) and other common substituents.

More specifically, W can represent any of halogen atoms (e.g., a fluorine atom, a chlorine atom, a bromine atom and an iodine atom); alkyl groups [each being a linear, branched or cyclic substituted or unsubstituted alkyl group, and including an alkyl group (preferably an alkyl group having 1 to 30 carbon atoms, such as methyl, ethyl, n-propyl, isopropyl, t-butyl, n-octyl, eicosyl, 2-chloroethyl, 2-cyanoethyl or 2-ethylhexyl), a cycloalkyl group (preferably a substituted or unsubstituted cycloalkyl group having 3 to 30 carbon atoms, such as cyclohexyl, cyclopentyl or 4-n-dodecylcyclohexyl), a bicycloalkyl group (preferably a substituted or unsubstituted bicycloalkyl group having 5 to 30 carbon atoms, which is a monovalent group corresponding to a bicycloalkane having 5 to 30 carbon atoms from which one hydrogen atom is removed, such as bicyclo[1,2,2]heptan-2-yl or bicyclo[2,2,2]octan-3-yl), and a tricyclo or more cycle structure; the alkyl contained in the following substituents (for example, alkyl of alkylthio group) means the alkyl group of this concept, which however further includes an alkenyl group and an alkynyl group]; alkenyl groups [each being a linear, branched or cyclic substituted or unsubstituted alkenyl group, and including an alkenyl group (preferably a substituted or unsubstituted alkenyl group having 2 to 30 carbon atoms, such as vinyl, allyl, pulenyl, geranyl or oleyl), a cycloalkenyl group (preferably a substituted or unsubstituted cycloalkenyl group having 3 to 30 carbon atoms, which is a monovalent group corresponding to a cycloalkene having 3 to 30 carbon atoms from which one hydrogen atom is removed, such as 2-cyclopenten-1-yl or 2-cyclohexen-1-yl), and a bicycloalkenyl group (substituted or unsubstituted bicycloalkenyl group, preferably a substituted or unsubstituted bicycloalkenyl group having 5 to 30 carbon atoms, which is a monovalent group corresponding to a bicycloalkene having one double bond from which one hydrogen atom is removed, such as bicyclo[2,2,1]hept-2-en-1-yl or bicyclo[2,2,2]oct-2-en-4-yl)]; alkynyl groups (preferably a substituted or unsubstituted alkynyl group having 2 to 30 carbon atoms, such as ethynyl, propargyl or trimethylsilylethynyl);

aryl groups (preferably a substituted or unsubstituted aryl group having 6 to 30 carbon atoms, such as phenyl, p-tolyl, naphthyl, m-chlorophenyl or o-hexadecanoylaminophenyl); heterocyclic groups (preferably a monovalent group corresponding to a 5- or 6-membered substituted or unsubstituted aromatic or nonaromatic heterocyclic compound from which one hydrogen atom is removed (the monovalent group may be condensed with a benzene ring, etc.), more preferably a 5- or 6-membered aromatic heterocyclic group having 3 to 30 carbon atoms, such as 2-furyl, 2-thienyl, 2-pyrimidinyl or 2-benzothiazolyl (the heterocyclic group may be a cationic heterocyclic group such as 1-methyl-2-pyridinio or 1-methyl-2-quinolinio)); a cyano group; a hydroxyl group; a nitro group; a carboxyl group; alkoxy groups (preferably a substituted or unsubstituted alkoxy group having 1 to 30 carbon atoms, such as methoxy, ethoxy, isopropoxy, t-butoxy, n-octyloxy or 2-methoxyethoxy); aryloxy groups (preferably a substituted or unsubstituted aryloxy group having 6 to 30 carbon atoms, such as phenoxy, 2-methylphenoxy, 4-t-butylphenoxy, 3-nitrophenoxy or 2-tetradecanoylaminophenoxy); silyloxy groups (preferably a silyloxy group having 3 to 20 carbon atoms, such as trimethylsilyloxy or t-butyldimethylsilyloxy); heterocyclic oxy groups (preferably a substituted or unsubstituted heterocyclic oxy group having 2 to 30 carbon atoms, such as 1-phenyltetrazol-5-oxy or 2-tetrahydropyranyloxy); acyloxy groups (preferably a formyloxy group, a substituted or unsubstituted alkylcarbonyloxy group having 2 to 30 carbon atoms or a substituted or unsubstituted arylcarbonyloxy group having 7 to 30 carbon atoms, such as formyloxy, acetyloxy, pivaloyloxy, stearoyloxy, benzoyloxy or p-methoxyphenylcarbonyloxy); carbamoyloxy groups (preferably a substituted or unsubstituted carbamoyloxy group having 1 to 30 carbon atoms, such as N,N-dimethylcarbamoyloxy, N,N-diethylcarbamoyloxy, morpholinocarbonyloxy, N,N-di-n-octylaminocarbonyloxy or N-n-octylcarbamoyloxy); alkoxycarbonyloxy groups (preferably a substituted or unsubstituted alkoxycarbonyloxy group having 2 to 30 carbon atoms, such as methoxycarbonyloxy, ethoxycarbonyloxy, t-butoxycarbonyloxy or n-octylcarbonyloxy); aryloxycarbonyloxy groups (preferably a substituted or unsubstituted aryloxycarbonyloxy group having 7 to 30 carbon atoms, such as phenoxycarbonyloxy, p-methoxyphenoxycarbonyloxy or p-n-hexadecyloxyphenoxycarbonyloxy); amino groups (preferably an amino group, a substituted or unsubstituted alkylamino group having 1 to 30 carbon atoms or a substituted or unsubstituted arylamino group having 6 to 30 carbon atoms, such as amino, methylamino, dimethylamino, anilino, N-methylanilino or diphenylamino);

ammonio groups (preferably an ammonio group or an ammonio group substituted with a substituted or unsubstituted alkyl, aryl or heterocycle having 1 to 30 carbon atoms, such as trimethylammonio, triethylammonio or diphenylmethylammonio), acylamino groups (preferably an formylamino group, a substituted or unsubstituted alkylcarbonylamino group having 1 to 30 carbon atoms or a substituted or unsubstituted arylcarbonylamino group having 6 to 30 carbon atoms, such as formylamino, acetylamino, pivaloylamino, lauroylamino, benzoylamino or 3,4,5-tri-n-octyloxyphenylcarbonylamino); aminocarbonylamino groups (preferably a substituted or unsubstituted aminocarbonylamino group having 1 to 30 carbon atoms, such as carbamoylamino, N,N-dimethylaminocarbonylamino, N,N-diethylaminocarbonylamino or morpholinocarbonylamino); alkoxycarbonylamino groups (preferably a substituted or unsubstituted alkoxycarbonylamino group having 2 to 30 carbon atoms, such as methoxycarbonylamino, ethoxycarbonylamino, t-butoxycarbonylamino, n-octadecyloxycarbonylamino or N-methyl-methoxycarbonylamino); aryloxycarbonylamino groups (preferably a substituted or unsubstituted aryloxycarbonylamino group having 7 to 30 carbon atoms, such as phenoxycarbonylamino, p-chlorophenoxycarbonylamino or m-n-octyloxyphenoxycarbonylamino); sulfamoylamino groups (preferably a substituted or unsubstituted sulfamoylamino group having 0 to 30 carbon atoms, such as sulfamoylamino, N,N-dimethylaminosulfonylamino or N-n-octylaminosulfonylamino); alkyl- or arylsulfonylamino groups (preferably a substituted or unsubstituted alkylsulfonylamino group having 1 to 30 carbon atoms or a substituted or unsubstituted arylsulfonylamino group having 6 to 30 carbon atoms, such as methylsulfonylamino, butylsulfonylamino, phenylsulfonylamino, 2,3,5-trichlorophenylsulfonylamino or p-methylphenylsulfonylamino); a mercapto group; alkylthio groups (preferably a substituted or unsubstituted alkylthio group having 1 to 30 carbon atoms, such as methylthio, ethylthio or n-hexadecylthio); arylthio groups (preferably a substituted or unsubstituted arylthio group having 6 to 30 carbon atoms, such as phenylthio, p-chlorophenylthio or m-methoxyphenylthio); heterocyclic thio groups (preferably a substituted or unsubstituted heterocyclic thio group having 2 to 30 carbon atoms, such as 2-benzothiazolylthio or 1-phenyltetrazol-5-ylthio);

sulfamoyl groups (preferably a substituted or unsubstituted sulfamoyl group having 0 to 30 carbon atoms, such as N-ethylsulfamoyl, N-(3-dodecyloxypropyl)sulfamoyl, N,N-dimethylsulfamoyl, N-acetylsulfamoyl, N-benzoylsulfamoyl or N-(N'-phenylcarbamoyl)sulfamoyl); a sulfo group; alkyl- or arylsulfinyl groups (preferably a substituted or unsubstituted alkylsulfinyl group having 1 to 30 carbon atoms or a substituted or unsubstituted arylsulfinyl group having 6 to 30 carbon atoms, such as methylsulfinyl, ethylsulfinyl, phenylsulfinyl or p-methylphenylsulfinyl); alkyl- or arylsulfonyl groups (preferably a substituted or unsubstituted alkylsulfonyl group having 1 to 30 carbon atoms or a substituted or unsubstituted arylsulfonyl group having 6 to 30 carbon atoms, such as methylsulfonyl, ethylsulfonyl, phenylsulfonyl or p-methylphenylsulfonyl); acyl groups (preferably a formyl group, a substituted or unsubstituted alkylcarbonyl group having 2 to 30 carbon atoms, a substituted or unsubstituted arylcarbonyl group having 7 to 30 carbon atoms or a substituted or unsubstituted heterocyclic carbonyl group having 4 to 30 carbon atoms wherein carbonyl is bonded with carbon atom thereof, such as acetyl, pivaloyl, 2-chloroacetyl, stearoyl, benzoyl, p-n-octyloxyphenylcarbonyl, 2-pyridylcarbonyl or 2-furylcarbonyl); aryloxycarbonyl groups (preferably a substituted or unsubstituted aryloxycarbonyl group having 7 to 30 carbon atoms, such as phenoxycarbonyl, o-chlorophenoxycarbonyl, m-nitrophenoxycarbonyl or p-t-butylphenoxycarbonyl); alkoxycarbonyl groups (preferably a substituted or unsubstituted alkoxycarbonyl group having 2 to 30 carbon atoms, such as methoxycarbonyl, ethoxycarbonyl, t-butoxycarbonyl or n-octadecyloxycarbonyl); carbamoyl groups (preferably a substituted or unsubstituted carbamoyl group having 1 to 30 carbon atoms, such as carbamoyl, N-methylcarbamoyl, N,N-dimethylcarbamoyl, N,N-di-n-octylcarbamoyl or N-(methylsulfonyl)carbamoyl); aryl- or heterocyclic azo groups (preferably a substituted or unsubstituted arylazo group having 6 to 30 carbon atoms or a substituted or unsubstituted heterocyclic azo group having 3 to 30 carbon atoms, such as phenylazo, p-chlorophenylazo or 5-ethylthio-1,3,4-thiadiazol-2-ylazo); imido groups (preferably N-succinimido or N-phthalimido); phosphino groups (preferably a substituted or unsubstituted phosphino group having 2 to 30 carbon atoms, such as dimethylphosphino, diphenylphosphino or methylphenoxyphosphino); phosphinyl groups (preferably a substituted or unsubstituted phosphinyl group having 2 to 30 carbon atoms, such as phosphinyl, dioctyloxyphosphinyl or diethoxyphosphinyl); phosphinyloxy groups (preferably a substituted or unsubstituted phosphinyloxy group having 2 to 30 carbon atoms, such as diphenoxyphosphinyloxy or dioctyloxyphosphinyloxy);

phosphinylamino groups (preferably a substituted or unsubstituted phosphinylamino group having 2 to 30 carbon atoms, such as dimethoxyphosphinylamino or dimethylaminophosphinylamino); a phospho group; silyl groups (preferably a substituted or unsubstituted silyl group having 3 to 30 carbon atoms, such as trimethylsilyl, t-butyldimethylsilyl or phenyldimethylsilyl); hydrazino groups (preferably a substituted or unsubstituted hydrazino group having 0 to 30 carbon atoms, such as trimethylhydrazino); and ureido groups (preferably a substituted or unsubstituted ureido group having 0 to 30 carbon atoms, such as N,N-dimethylureido).

Two W's can cooperate with each other to thereby form a ring (any of aromatic or nonaromatic hydrocarbon rings and heterocycles (these can be combined into polycyclic condensed rings), for example, a benzene ring, a naphthalene ring, an anthracene ring, a phenanthrene ring, a fluorene ring, a triphenylene ring, a naphthacene ring, a biphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofuran ring, a quinolizine ring, a quinoline ring, a phthalazine ring, a naphthylidine ring, a quinoxaline ring, a quinoxazoline ring, an isoquinoline ring, a carbazole ring, a phenanthridine ring, an acridine ring, a phenanthroline ring, a thianthrene ring, a chromene ring, a xanthene ring, a phenoxathine ring, a phenothiazine ring or a phenazine ring).

With respect to those having hydrogen atoms among the above substituents W, the hydrogen atoms may be replaced with the above substituents. Examples of such hydrogen having substituents include a —$CONHSO_2$— group (sulfonylcarbamoyl or carbonylsulfamoyl), a —CONHCO— group (carbonylcarbamoyl) and a —$SO_2NHSO_2$— group (sulfonylsulfamoyl).

More specifically, examples of such hydrogen having substituents include an alkylcarbonylaminosulfonyl group (e.g., acetylaminosulfonyl), an arylcarbonylaminosulfonyl group (e.g., benzoylaminosulfonyl), an alkylsulfonylaminocarbonyl group (e.g., methylsulfonylaminocarbonyl) and an arylsulfonylaminocarbonyl group (e.g., p-methylphenylsulfonylaminocarbonyl).

The heterocyclic compounds having three or more heteroatoms for use in the present invention, compound (A), will be described. Heteroatom refers to atoms other than carbon and hydrogen atoms. In the present invention, heterocycle refers to a cyclic compound having at least three heteroatoms. The heteroatom of the "heterocycle having three or more heteroatoms" refers to only atoms as constituents of a heterocyclic ring system, and does not mean atoms positioned outside the ring system and atoms as parts of further substituents of the ring system.

With respect to polynuclear heterocycles, those wherein the number of heteroatoms in all the ring systems is three or more are included. For example, 1,3,4,6-tetrazaindene is included therein because the number of heteroatoms is 4.

The number of heteroatoms, although there is no particular upper limit, is preferably 10 or less, more preferably 8 or less, still more preferably 6 or less, and most preferably 4 or less.

Although any heterocyclic compounds satisfying the above requirements can be employed, the heteroatom is preferably a nitrogen atom, a sulfur atom, an oxygen atom, a selenium atom, a tellurium atom, a phosphorus atom, a silicon atom or a boron atom. More preferably, the heteroatom is a nitrogen atom, a sulfur atom, an oxygen atom or a selenium atom. Further more preferably, the heteroatom is a nitrogen atom, a sulfur atom or an oxygen atom. Most preferably, the heteroatom is a nitrogen atom or a sulfur atom.

Although the number of members of heterocycles is not limited, a 3- to 8-membered ring is preferred. A 5- to 7-membered ring is more preferred. A 5- or 6-membered ring is most preferred.

Although the heterocycles may be saturated or unsaturated, those having at least one unsaturated moiety are preferred. Those having at least two unsaturated moieties are more preferred. Stated in another way, although the heterocycle may be any of aromatic, pseudo-aromatic and nonaromatic heterocycles, aromatic and pseudo-aromatic heterocycles are preferred.

As the heterocycles thereof, there can be mentioned, for example, a triazole ring, an oxadiazole ring, a thiadiazole ring, a benzotriazole ring, a tetrazaindene ring, a pentazaindene ring, a purine ring, a tetrazole ring, a pyrazolotriazole ring and the like.

Representative examples of heterocycles will be listed below.

As examples of the 6/5 bicyclo heterocyclic compounds according to the present invention, there can be mentioned a tetrazaindene ring, a pentazaindene ring and a hexazaindene ring.

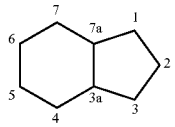

The position of nitrogen atom will be numbered in accordance with the above structures. Then, use can be made of, for example, 1,3,4,6- and 1,3,5,7- (these known as purines), 1,3,5,6-, 1,2,3a,5-, 1,2,3a,6-, 1,2,3a,7-, 1,3,3a,7-, 1,2,4,6-, 1,2,4,7-, 1,2,5,6- and 1,2,5,7-tetrazaindene rings. These compounds can also be expressed as derivatives of imidazo-, pyrazolo- or triazolopyrimidine ring, pyridazine ring and pyrazine ring. Further, use can be made of, for example, 1,2,3a,4,7-, 1,2,3a,5,7- and 1,3,3a,5,7-pentazaindene rings. Still further, use can be made of, for example, a 1,2,3a,4,6,7-hexazaindene ring. Preferably, use is made of 1,3,4,6-, 1,2,5,7-, 1,2,4,6-, 1,2,3a,7- and 1,3,3a,7-tetrazaindene rings.

Preferred examples thereof will be illustrated below.

(a-1)

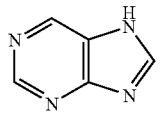

(a-2)

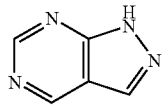

(a-3)

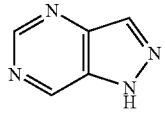

(a-4)

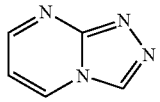

(a-5)

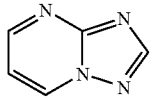

With respect to these tetrazaindene rings, pentazaindene rings and hexazaindene rings, it is preferred to avoid bonding of an ionizable substituent, such as hydroxyl, thiol, primary amino or secondary amino, to a ring atom so as to induce conjugation to ring nitrogen to thereby form a tautomer of heterocycle.

Furthermore, there can be mentioned the following heterocycles.

(a-6)

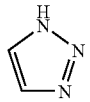

-continued (a-7)

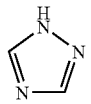

(a-8)

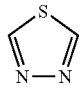

(a-9)

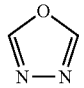

(a-10)

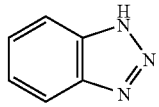

(a-11)

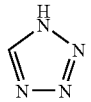

(a-12)

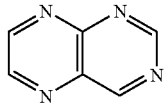

(a-13)

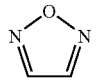

(a-14)

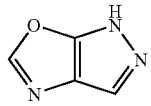

(a-15)

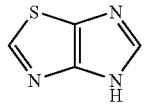

Although heterocycles resulting from partial or entire saturation of the above heterocycles can be used, it is preferred to employ those unsaturated as aforementioned.

These heterocycles, unless contrary to the definition of "heterocycle having three or more heteroatoms" of the present invention, may have any substituents or may be in the form of any condensed ring. As the substituents, there can be mentioned the aforementioned W. The tertiary nitrogen atom contained in heterocycles may be substituted into a quaternary nitrogen. Moreover, any other tautomeric structures which can be drawn with respect to heterocycles are chemically equivalent to each other.

With respect to the heterocycles of the present invention, it is preferred that free thiol (—SH) and thiocarbonyl (>C═S) be in unsubstituted form.

Among the above heterocycles, heterocycles (a-1) to (a-11) are preferred.

Although the compound (A) of the present invention may be a compound which reacts or does not react with oxidizing developing agents, it is preferred to employ a compound which does not react with oxidizing developing agents. The compound which does not react with oxidizing developing agents is preferably a compound which induces no marked direct chemical reaction or redox reaction with oxidizing developing agents. Further, the compound which does not react with oxidizing developing agents is preferably a compound which is not a coupler and does not effect reaction with oxidizing developing agents leading to formation of dyes or any other products. Herein, the compound which induces no marked direct chemical reaction or redox reaction with oxidizing developing agents refers to any of those whose reactivity (CRV) determined by the following method is a given value or below.

The reactivity (CRV) of the compound of the present invention with oxidizing developing agents can be determined by, for example, the following method.

Test sensitive material (A) was exposed to white light specified later and processed with the use of the following color developer (a) in the same manner as described in Example 1 except that the processing time in color development step was changed to 1 min 30 sec. The cyan density of the thus processed sensitive material was measured, and the difference from the cyan density exhibited when the processing was performed with the use of a color developer corresponding to the color developer (a) devoid of the compound of the present invention was calculated. This difference is preferably in the range of 0 to 1.0, more preferably 0 to 0.5, and most preferably 0 to 0.3.

| Test sensitive material (A) | |
|---|---|
| (Support) | cellulose triacetate |
| (Emulsion layer) | |
| Em-A in terms of Ag | 1.07 g/m$^2$ |
| Gelatin | 2.33 g/m$^2$ |
| ExC-1 | 0.76 g/m$^2$ |
| ExC-4 | 0.42 g/m$^2$ |
| Tricresyl phosphate | 0.62 g/m$^2$ |
| (Protective layer) | |
| Gelatin | 2.00 g/m$^2$ |
| H-1 | 0.33 g/m$^2$ |
| B-1 (diam. 1.7 μm) | 0.10 g/m$^2$ |
| B-2 (diam. 1.7 μm) | 0.30 g/m$^2$ |
| B-3 | 0.10 g/m$^2$ |

The characteristics of emulsion Em-A and structural formulae of compounds employed in the above test sensitive material (A) were specified in Example 1 described later.

| Color developer (a) | Unit (g) |
|---|---|
| Diethylenetriamine pentaacetic acid | 1.0 |
| 1-hydroxyethyliden-1,1-diphosphonate | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-(β-hydroxyethyl)amino]-2-methylaniline sulfate | 4.5 |
| Compound of invention | 2.0 |
| Water to make | 1.0 L |
| pH (adjusted by potassium hydroxide and surfuric acid) | 10.05 |

As substituents for the above compounds of the present invention, there can be selected any of those used by persons skilled in the art to which the present invention pertains for attaining desired photographic performance in specified usage. Such substituents include, for example, a hydrophobic group (ballasting group), a solubilizing group, a blocking group and a release or releasable group. With respect to these groups, generally, the number of carbon atoms thereof is preferably in the range of 1 to 60, more preferably 1 to 40.

For controlling the migration in photosensitive material, the compounds of the present invention in the molecules may contain a hydrophobic group or ballasting group of high molecular weight, or may contain a polymer main chain.

The number of carbon atoms of representative ballasting groups is preferably in the range of 0 to 60, more preferably 1 to 50, still more preferably 1 to 41, and most preferably 1 to 32. As these substituents, there can be mentioned substituted or unsubstituted alkyl, aryl and heterocyclic groups having 0 to 60, preferably 1 to 48, more preferably 2 to 38, still more preferably 2 to 32 and most preferably 2 to 25 carbon atoms. These preferably contain branches. Examples of representative substituents on these groups include alkyl, aryl, alkoxy, aryloxy, alkylthio, hydroxyl, halogen, alkoxycarbonyl, aryloxycarbonyl, carboxyl, acyl, acyloxy, amino, anilino, carbonamido, carbamoyl, alkylsulfonyl, arylsulfonyl, sulfonamido and sulfamoyl. These substituents generally each have 1 to 42 carbon atoms. For example, there can be mentioned the aforementioned W. These substituents may have further substituents.

The ballasting groups will be described in greater detail. Preferred examples thereof include an alkyl group (having 1 to 60 carbon atoms, such as methyl, ethyl, propyl, isobutyl, t-butyl, t-octyl, 1-ethylhexyl, nonyl, undecyl, pentadecyl, n-hexadecyl or 3-decanamidopropyl); an alkenyl group (having 2 to 60 carbon atoms, such as vinyl, allyl or oleyl); a cycloalkyl group (having 5 to 60 carbon atoms, such as cyclopentyl, cyclohexyl, 4-t-butylcyclohexyl, 1-indanyl or cyclododecyl); an aryl group (having 6 to 60 carbon atoms, such as phenyl, p-tolyl or naphthyl); an acylamino group (having 2 to 60 carbon atoms, such as acetylamino, n-butanamido, octanoylamino, 2-hexyldecanamido, 2-(2',4'-di-t-amylphenoxy)butanamido, benzoylamino or nicotinamido); a sulfonamido group (having 1 to 60 carbon atoms, such as methanesulfonamido, octanesulfonamido or benzenesulfonamido); a ureido group (having 2 to 60 carbon atoms, such as decylaminocarbonylamino or di-n-octylaminocarbonylamino); a urethane group (having 2 to 60 carbon atoms, such as dodecyloxycarbonylamino, phenoxycarbonylamino or 2-ethylhexyloxycarbonylamino); an alkoxy group (having 1 to 60 carbon atoms, such as methoxy, ethoxy, butoxy, n-octyloxy, hexadecyloxy or methoxyethoxy); an aryloxy group (having 6 to 60 carbon atoms, such as phenoxy, 2,4-di-t-amylphenoxy, 4-t-octylphenoxy or naphthoxy); an alkylthio group (having 1 to 60 carbon atoms, such as methylthio, ethylthio, butylthio or hexadecylthio); an arylthio group (having 6 to 60 carbon atoms, such as phenylthio or 4-dodecyloxyphenylthio); an acyl group (having 1 to 60 carbon atoms, such as acetyl, benzoyl, butanoyl or dodecanoyl); a sulfonyl group (having 1 to 60 carbon atoms, such as methanesulfonyl, butanesulfonyl or toluenesulfonyl); a cyano group; a carbamoyl group (having 1 to 60 carbon atoms, such as N,N-dicyclohexylcarbamoyl); a sulfamoyl group (having 0 to 60 carbon atoms, such as N,N-dimethylsulfamoyl); a hydroxyl group; a sulfo group; a carboxyl group; a nitro group; an alkylamino group (having 1 to 60 carbon atoms, such as methylamino, diethylamino, octylamino or octadecylamino); an arylamino group (having 6 to 60 carbon atoms, such as phenylamino, naphthylamino or N-methyl-N-phenylamino); a heterocyclic group (having 0 to 60 carbon atoms, preferably heterocyclic group wherein an atom selected from among a nitrogen atom, an oxygen atom and a sulfur atom is used as a heteroatom being a constituent of the ring, more preferably heterocyclic group wherein not only a heteroatom but also a carbon atom is used as constituent atoms of the ring, and especially heterocyclic group having a 3 to 8-, preferably 5 or 6-membered ring, such as groups listed above as being represented by W); or an acyloxy group (having 1 to 60 carbon atoms, such as formyloxy, acetyloxy, myristoyloxy or benzoyloxy).

Among these groups, the alkyl, cycloalkyl, aryl, acylamino, ureido, urethane, alkoxy, aryloxy, alkylthio, arylthio, acyl, sulfonyl, cyano, carbamoyl and sulfamoyl groups include those having substituents. Examples of such substituents include an alkyl group, a cycloalkyl group, an aryl group, an acylamino group, a ureido group, a urethane group, an alkoxy group, an aryloxy group, an alkylthio group, an arylthio group, an acyl group, a sulfonyl group, a cyano group, a carbamoyl group, a sulfamoyl group and a halogen atom.

Among these substituents, an alkyl group, an aryl group, an alkoxy group and an aryloxy group are preferred. An alkyl group, an alkoxy group and an aryloxy group are more preferred. The most preferred substituent is a branched alkyl group.

The total number of carbon atoms of these substituents, although not particularly limited, is preferably in the range of 0 to 60, more preferably 0 to 50, and still more preferably 1 to 45.

The compound (A) of the present invention is preferably added to an aqueous solution. Accordingly, it is preferred that the compound of the present invention have a solubilizing group among the aforementioned substituent hydrophobic group (ballasting group), solubilizing group and blocking group. The solubilizing group, although not limited as long as it is a group of high hydrophilicity, is preferably a sulfo group or a salt thereof (for example, alkali metal salt), a carboxy group or a salt thereof (for example, alkali metal salt), a hydroxy group, or an ether group.

The compound (A) of the present invention is added to the development processing solution containing a color developing agent and/or processing solution applied to the photosensitive material before the use of the development processing solution (hereinafter also referred to as "preprocessing solution").

The compound (A) of the present invention can also be added to the photosensitive material. Provided that it may occur that as a result of dissolution into the processing solution from the sensitive material loaded with the compound (A) of the present invention during running, the compound (A) of the present invention becomes contained in the development processing solution or preprocessing solution. The development processing solution and preprocessing solution which thus contain only the compound (A) of the present invention having been dissolved out from the sensitive material are not covered by the development processing solution and preprocessing solution "having been loaded with (containing) the compound (A) of the present invention" as prescribed in the present invention. On the other hand, it may occur that when the compound (A) is added to the preprocessing solution, the preprocessing solution remaining in the sensitive material is brought into the development processing solution. In this case, the development processing solution is covered by the development processing solution "containing the compound (A) of the present invention" as prescribed in the present invention.

The processing using the solution containing the compound (A) of the present invention can preferably be accomplished by the following methods. Although any of the methods can be employed, it is preferred to employ the method (1).

(1) Method of carrying out development processing with the use of developing solution loaded with the compound (A) of the present invention. In this method, it is preferred to employ the compound (A) that is soluble in the developing solution.

(2) Method of carrying out application (immersion, spray, etc.) of the preprocessing solution containing the compound (A) of the present invention but not containing any developing agent to the silver halide photosensitive material and thereafter performing development processing. In this method, the compound (A) of the present invention, although may be dissolved in any type of solvent, is preferably dissolved in water or methanol, most preferably in water. In the dissolution in water, the pH optimum for dissolution of the compound (A) of the present invention can be selected (preferred pH: 4.0 to 11.0). As a pH regulator, use can be made of $K_2CO_3$, $NaHCO_3$, etc. In the preprocessing, use can be made of KBr, etc. in order to adjust the pAg as well as the pH regulator. The temperature of the preprocessing solution, although not particularly limited as long as the effects of the present invention can be exerted, can generally be in the range of 20 to 50° C. The duration of application of the preprocessing solution to the sensitive material, although also not particularly limited as long as the effects of the present invention can be exerted, can generally be in the range of 10 sec to 5 min.

Although the sensitive material after application of the preprocessing solution thereto can be subjected to processing other than development processing, it is preferred that without such other processing, the sensitive material be subjected to development processing.

(3) Method of immersing the silver halide photosensitive material in the solution containing the compound (A) of the present invention but not containing any developing agent and thereafter carrying out development processing with the use of developing solution loaded with the compound (A) of the present invention.

The compound (A) of the present invention, when required for neutralizing the charges thereof, can contain a required number of required cations or anions. As representative cations, there can be mentioned inorganic cations such as proton ($H^+$), alkali metal ions (e.g., sodium ion, potassium ion and lithium ion) and alkaline earth metal ions (e.g., calcium ion); and organic ions such as ammonium ions (e.g., ammonium ion, tetraalkylammonium ion, triethylammonium ion, pyridinium ion, ethylpyridinium ion and 1,8-diazabicyclo[5,4,0]-7-undecenium ion). The anions can be inorganic anions or organic anions. As such, there can be mentioned halide anions (e.g., fluoride ion, chloride ion and iodide ion), substituted arylsulfonate ions (e.g., p-toluenesulfonate ion and p-chlorobenzenesulfonate ion), aryldisulfonate ions (e.g., 1,3-benzenedisulfonate ion, 1,5-naphthalenedisulfonate ion and 2,6-naphthalenedisulfonate ion), alkylsulfate ions (e.g., methylsulfate ion), sulfate ion, thiocyanate ion, perchlorate ion, tetrafluoroborate ion, picrate ion, acetate ion and trifluoromethanesulfonate ion. Further, use can be made of ionic polymers and other dyes having charges opposite to those of dyes. $CO_2^-$ and $SO_3^-$, when having a proton as a counter ion, can be indicated as $CO_2H$ and $SO_3H$, respectively.

It is preferred to use combinations of aforementioned individual preferred compounds (especially combinations of individual most preferred compounds) as the compound (A) of the present invention.

Among the heterocyclic compounds (A) according to the present invention, especially preferred specific examples will be shown below, which however in no way limit the scope of the invention.
(1)
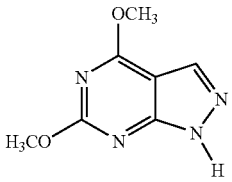
(2)
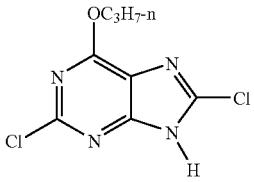
(3)
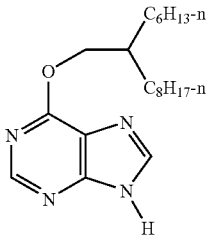
(4)
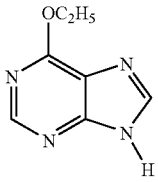
(5)
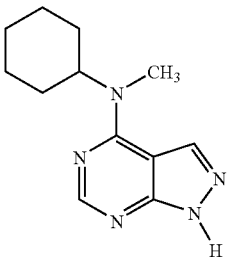
(6)
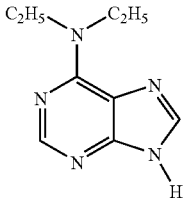
(7)
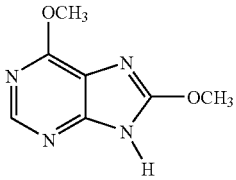
-continued
(8)
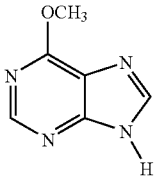
(9)
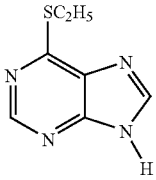
(10)
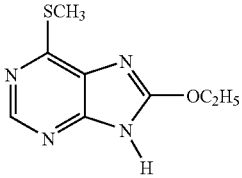
(11)
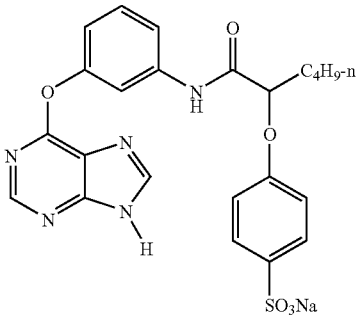
(12)
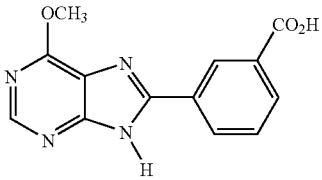
(13)
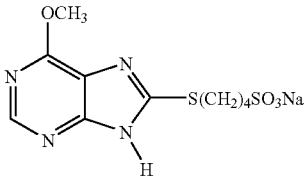
(14)
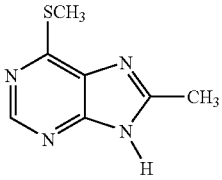

-continued
(15)
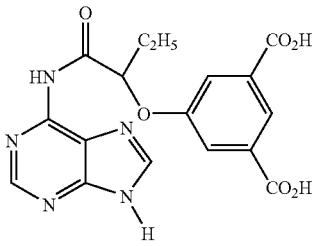
(16)
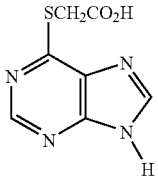
(17)
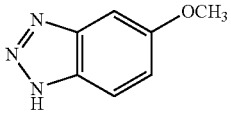
(18)
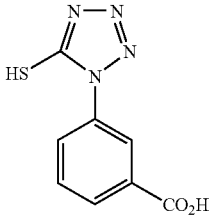
(19)
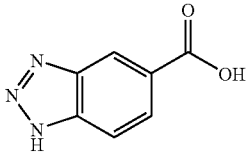
(20)
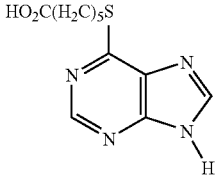
(21)
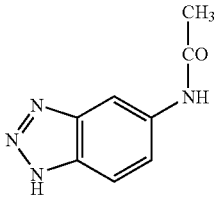
(22)
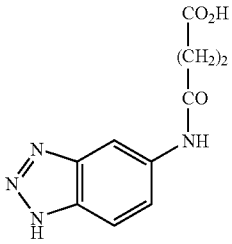
-continued
(23)
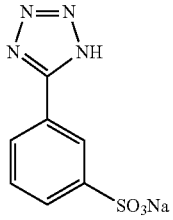
(24)
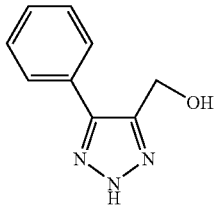
(25)
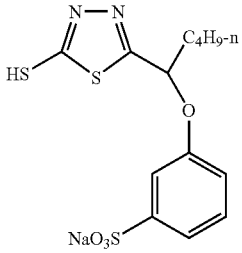
(26)
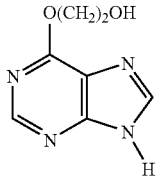
(27)
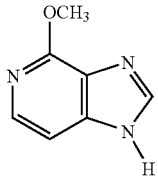
(28)
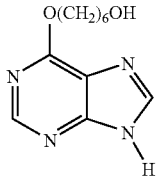
(29)
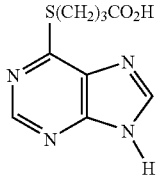

-continued (30)

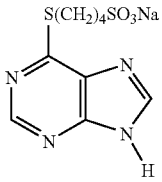

(31)

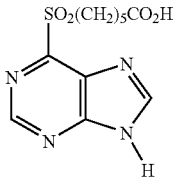

(32)

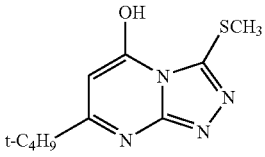

(33)

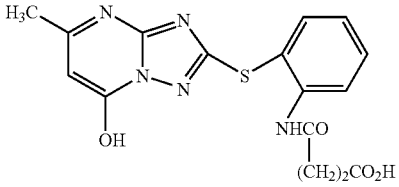

(34)

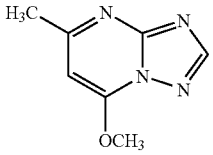

(35)

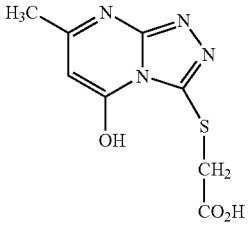

(36)

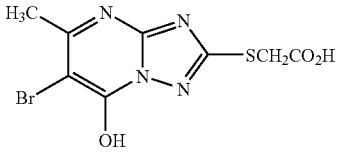

(37)

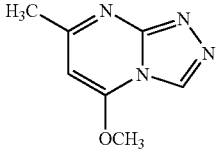

(38)

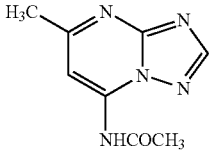

-continued (39)

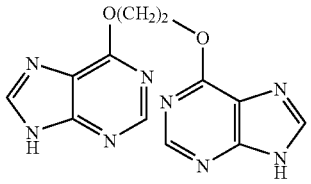

(40)

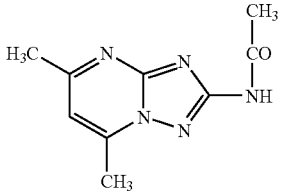

(41)

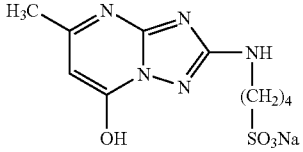

(42)

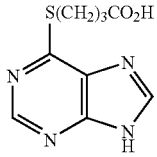

With respect to the compounds of the present invention, any one thereof can be used, or two or more can be used in combination. The number and type of compounds for use can be arbitrarily selected.

As the compound (A) of the present invention, use can be made of those described in, for example, "The Chemistry of Heterocyclic Compounds—A Series of Monographs" vol. 1-59, edited by Edward C. Taylor and Arnold Weissberger and published by John Wiley & Sons and "Heterocyclic Compounds" vol. 1-6, edited by Robert C. Elderfield and published by John Wiley & Sons. The compound (A) of the present invention can be synthesized by the processes described therein.

The compound (A) of the present invention can be used in combination with one or more arbitrary methods capable of exerting sensitivity enhancing effects or compounds capable of exerting sensitivity enhancing effects. The number and type of employed methods and contained compounds can also be arbitrarily selected.

For example, the compounds of the present invention may be used in combination with compounds each having at least three heteroatoms as described in JP-A's-2000-194085 and 2003-156823.

Irrespective of whether the addition of the compound (A) of the present invention is conducted to the developer or to processing solutions used in processing prior to the development processing, the compound (A) of the present invention is preferably added in an amount of 0.0001 to 100 g/L, more preferably 0.001 to 20 g/L, and most preferably 0.01 to 10 g/L of processing solution. The use of the compound (A) of the present invention in these ranges of amounts is also preferred from the viewpoint of planarity. Two or more types of compounds (A) of the present invention may be used in combination. Use of two or more types of compounds (A) in combination is preferred from the viewpoint of enhancing of the color reproduction of color images.

As described in the background of the invention, generally, the photographic speed depends on the size of silver halide emulsion grains. The larger the emulsion grains, the higher the photographic speed. However, the graininess is deteriorated in accordance with an increase of the size of silver halide grains. Therefore, the speed and the graininess fall in trade-off relationship.

The speed increase can be accomplished by the method of increasing coupler activity or the method of decreasing the amount of development inhibitor release coupler (DIR coupler) as well as the above increasing of the size of silver halide emulsion grains. However, when the speed increase is effected by these methods, graininess deterioration accompanies the same. These methods of changing of the size of emulsion grains, regulation of coupler activity and regulation of the amount of DIR coupler, in speed/graininess trade-off relationship, provide only "regulatory means" for deteriorating graininess while increasing speed, or improving graininess while lowering speed.

In the present invention, "enhancing the sensitivity" is not intended to provide a method of speed increase accompanied by graininess deterioration matching the speed increase.

According to the present invention, there is provided a method of speed increase not accompanied by graininess deterioration, or a method of speed increase wherein the speed increase is conspicuous as compared with graininess deterioration. In the present invention, when speed increase and graininess deterioration simultaneously occur, speed comparison is effected after graininess matching conducted by the above "regulatory means" to thereby find a substantial speed increase.

The substantial photographic speed increase is defined as exhibiting a speed difference of 0.02 or greater when photosensitive materials are exposed through continuous wedge and the speeds, in terms of the logarithm of inverse number of exposure intensity realizing minimum density+0.8, thereof are compared. In the present invention, when with respect to the sample 101 described in Example 1 of the specification of the present application, the photographic speed exhibited upon processing with the use of a developer having a heterocyclic compound having three or more heteroatoms added thereto in the same manner as in Experiment 103 realizes a substantial increase over the photographic speed exhibited upon processing conducted in the same manner as in Experiment 101, the heterocyclic compound is defined as the compound (A) of the present invention.

Further, it is preferred that the photosensitive material of the present invention contain "a compound which undergoes a one-electron oxidation so as to form a one electron oxidation product capable of releasing one or more electrons".

This compound is preferably selected from among the following compounds of type 1 and type 2.

(Type 1)

Compound which undergoes a one-electron oxidation so as to form a one-electron oxidation product capable of, through subsequent bond cleavage reaction, releasing one or more electrons.

(Type 2)

Compound which undergoes a one-electron oxidation so as to form a one-electron oxidation product capable of, after subsequent bond formation reaction, releasing one or more electrons.

First, the compound of type 1 will be described.

With respect to the compound of type 1, as the compound which undergoes a one-electron oxidation so as to form a one-electron oxidation product capable of, through subsequent bond cleavage reaction, releasing one electron, there can be mentioned compounds referred to as "one photon two electrons sensitizers" or "deprotonating electron donating sensitizers", as described in, for example, JP-A-9-211769 (examples: compounds PMT-1 to S-37 listed in Tables E and F on pages 28 to 32), JP-A-9-211774, JP-A-11-95355 (examples: compounds INV 1 to 36), PCT Japanese Translation Publication 2001-500996 (examples: compounds 1 to 74, 80 to 87 and 92 to 122), U.S. Pat. Nos. 5,747,235 and 5,747,236, EP 786692A1 (examples: compounds INV 1 to 35), EP 893732A1 and U.S. Pat. Nos. 6,054,260 and 5,994,051. Preferred ranges of these compounds are the same as described in the cited patent specifications.

With respect to the compound of type 1, as the compound which undergoes a one-electron oxidation so as to form a one-electron oxidation product capable of, through subsequent bond cleavage reaction, releasing one or more electrons, there can be mentioned compounds of the general formula (1) (identical with the general formula (1) described in JP-A-2003-114487), the general formula (2) (identical with the general formula (2) described in JP-A-2003-114487), the general formula (3) (identical with the general formula (3) described in JP-A-2003-114487), the general formula (3) (identical with the general formula (1) described in JP-A-2003-114488), the general formula (4) (identical with the general formula (2) described in JP-A-2003-114488), the general formula (5) (identical with the general formula (3) described in JP-A-2003-114488), the general formula (6) (identical with the general formula (1) described in JP-A-2003-75950), the general formula (8) (identical with the general formula (1) described in JP-A-2004-239943) and the general formula (9) (identical with the general formula (3) described in JP-A-2004-245929) among the compounds of inducing the reaction represented by the chemical reaction formula (1) (identical with the chemical reaction formula (1) described in JP-A-2004-245929). Preferred ranges of these compounds are the same as described in the cited patent specifications.

General formula (1)

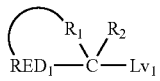

General formula (2)

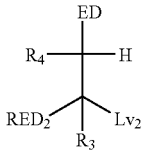

In the general formulae (1) and (2), each of $RED_1$ and $RED_2$ represents a reducing group. $R_1$ represents a nonmetallic atom group capable of forming a cyclic structure corresponding to a tetrahydro form or hexahydro form of 5-membered or 6-membered aromatic ring (including aromatic heterocycle) in cooperation with carbon atom (C) and $RED_1$. Each of $R_2$, $R_3$ and $R_4$ represents a hydrogen atom or a substituent. Each of $L_{v1}$ and $L_{v2}$ represents a split off group.

ED represents an electron donating group.

General formula (3)

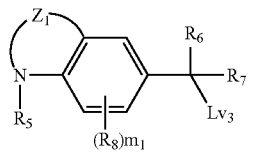

General formula (4)

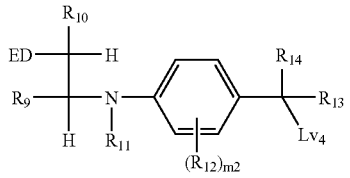

General formula (5)

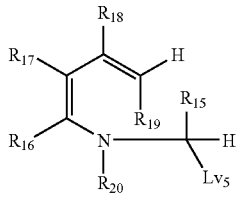

In the general formulae (3), (4) and (5), $Z_1$ represents an atomic group capable of forming a 6-membered ring in cooperation with a nitrogen atom and two carbon atoms of benzene ring. Each of $R_5$, $R_6$, $R_7$, $R_9$, $R_{10}$, $R_{11}$, $R_{13}$, $R_{14}$, $R_{15}$, $R_{16}$, $R_{17}$, $R_{18}$ and $R_{19}$ represents a hydrogen atom or a substituent. $R_{20}$ represents a hydrogen atom or a substituent, provided that when $R_{20}$ represents a non-aryl group, $R_{16}$ and $R_{17}$ are bonded to each other to thereby form an aromatic ring or aromatic heterocycle. Each of $R_8$ and $R_{12}$ represents a substituent capable of substitution on benzene ring. $m_1$ is an integer of 0 to 3. $m_2$ is an integer of 0 to 4. Each of $L_{v3}$, $L_{v4}$ and $L_{v5}$ represents a split off group.

General formula (6)

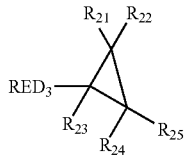

General formula (7)

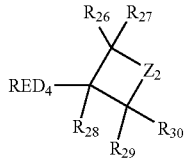

In the general formulae (6) and (7), each of $RED_3$ and $RED_4$ represents a reducing group. Each of $R_{21}$ to $R_{30}$ represents a hydrogen atom or a substituent. $Z_2$ represents —$CR_{111}R_{112}$—, —$NR_{113}$— or —O—. Each of $R_{111}$ and $R_{112}$ independently represents a hydrogen atom or a substituent. $R_{113}$ represents a hydrogen atom, an alkyl group, an aryl group or a heterocyclic group.

General formula (8)

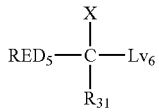

In the general formula (8), $RED_5$ is a reducing group, representing an arylamino group or a heterocyclic amino group. $R_{31}$ represents a hydrogen atom or a substituent. X represents an alkoxy group, an aryloxy group, a heterocyclic oxy group, an alkylthio group, an arylthio group, a heterocyclic thio group, an alkylamino group, an arylamino group or a heterocyclic amino group. $L_{v6}$ is a split off group, representing carboxyl or its salt or a hydrogen atom.

Chemical reaction formula (1)

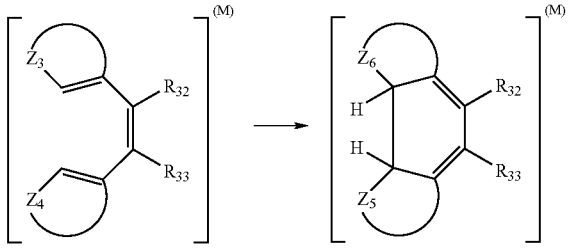

General formula (9)

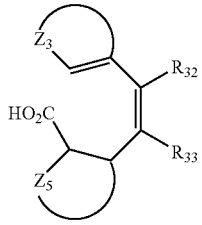

The compound represented by the general formula (9) is one which undergoes a two-electron oxidation accompanied by decarbonation and is further oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. M represents a radical, a radical cation or a cation. In the general formula (9), $R_{32}$, $R_{33}$ and $Z_3$ have the same meaning as in the chemical reaction formula (1). Each of $Z_5$ and $Z_6$ represents a group capable of forming a 5- or 6-membered cycloaliphatic hydrocarbon group or heterocyclic ring in cooperation with C—C.

Now, the compounds of type 2 will be described.

As the compounds of type 2, namely, compounds which undergo a one-electron oxidation so as to form a one-electron oxidation product capable of, through subsequent bond formation reaction, releasing one or more electrons, there can be mentioned compounds of the general formula (10) (identical with the general formula (1) described in JP-A-2003-140287) and compounds of the general formula (11) (identical with the general formula (2) described in JP-A-2004-245929) capable of inducing the reaction represented by the chemical reaction formula (1) (identical with the chemical reaction formula (1) described in JP-A-2004-245929). Preferred ranges of these compounds are the same as described in the cited patent specifications.

$RED_6$-Q-Y General formula (10)

In the general formula (10), $RED_6$ represents a reducing group which undergoes a one-electron oxidation. Y represents a reactive group containing carbon to carbon double bond moiety, carbon to carbon triple bond moiety, aromatic group moiety or nonaromatic heterocyclic moiety of benzo condensation ring capable of reacting with a one-electron oxidation product formed by a one-electron oxidation of $RED_6$ to thereby form a new bond. Q represents a linking group capable of linking $RED_6$ with Y.

Chemical reaction formula (1)

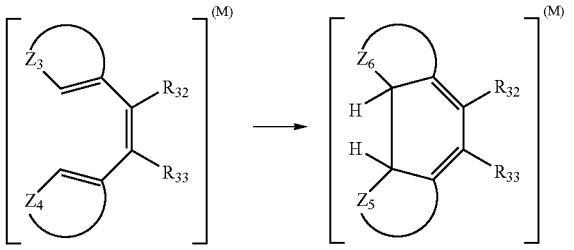

General formula (11)

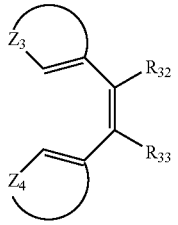

The compound represented by the general formula (11) is one oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. Each of $Z_5$ and $Z_6$ represents a group capable of forming a 5- or 6-membered cycloaliphatic hydrocarbon group or heterocyclic ring in cooperation with C—C. M represents a radical, a radical cation or a cation. In the general formula (11), $R_{32}$, $R_{33}$, $Z_3$ and $Z_4$ have the same meaning as in the chemical reaction formula (1).

Among the compounds of types 1 and 2, "compounds having in the molecule an adsorptive group on silver halides" and "compounds having in the molecule a partial structure of spectral sensitizing dye" are preferred. As representative examples of adsorptive groups on silver halides, there can be mentioned groups described in JP-A-2003-156823, page 16 right column line 1 to page 17 right column line 12. The partial structure of spectral sensitizing dye is as described in the same reference, page 17 right column line 34 to page 18 left column line 6.

Among the compounds of types 1 and 2, "compounds having in the molecule at least one adsorptive group on silver halides" are more preferred. "Compounds having in the same molecule two or more adsorptive groups on silver halides" are still more preferred. When two or more adsorptive groups are present in a single molecule, they may be identical with or different from each other.

As preferred adsorptive groups, there can be mentioned a mercapto-substituted nitrogenous heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazoium-3-thiolate group) and a nitrogenous heterocyclic group capable of forming an iminosilver (>NAg) and having —NH— as a partial structure of heterocycle (e.g., benzotriazole group, benzimidazole group or indazole group). Among these, a 5-mercaptotetrazole group, a 3-mercapto-1,2,4-triazole group and a benzotriazole group are more preferred. A 3-mercapto-1,2,4-triazole group and a 5-mercaptotetrazole group are most preferred.

An adsorptive group having two or more mercapto groups as a partial structure in the molecule is also especially preferred. The mercapto group (—SH) when tautomerizable may be in the form of a thione group. As preferred examples of adsorptive groups each having two or more mercapto groups as a partial structure (e.g., dimercapto-substituted nitrogenous heterocyclic groups), there can be mentioned a 2,4-dimercaptopyrimidine group, a 2,4-dimercaptotriazine group and a 3,5-dimercapto-1,2,4-triazole group.

Moreover, a quaternary salt structure of nitrogen or phosphorus can preferably be used as the adsorptive group. As the quaternary salt structure of nitrogen, there can be mentioned, for example, an ammonio group (such as trialkylammonio, dialkylaryl(heteroaryl)ammonio or alkyldiaryl(heteroaryl)ammonio) or a group containing a nitrogenous heterocyclic group containing a quaternarized nitrogen atom. As the quaternary salt structure of phosphorus, there can be mentioned, a phosphonio group (such as trialkylphosphonio, dialkylaryl(heteroaryl)phosphonio, alkyldiaryl(heteroaryl)phosphonio or triaryl(heteroaryl)phosphonio). Among these, the quaternary salt structure of nitrogen is more preferred. The 5- or 6-membered nitrogenous aromatic heterocyclic group containing a quaternarized nitrogen atom is still more preferred. A pyridinio group, a quinolinio group and an isoquinolinio group are most preferred. The above nitrogenous heterocyclic group containing a quaternarized nitrogen atom may have any arbitrary substituent.

As examples of counter anions to the quaternary salts, there can be mentioned a halide ion, a carboxylate ion, a sulfonate ion, a sulfate ion, aperchlorate ion, a carbonate ion, a nitrate ion, $BF_4^-$, $PF_6^-$ and $Ph_4B^-$. When in the molecule a group with negative charge is had by carboxylate, etc., an intramolecular salt may be formed therewith. A chloro ion, a bromo ion or a methanesulfonate ion is most preferred as a counter anion not present in the molecule.

Among the compounds of types 1 and 2 having the structure of quaternary salt of nitrogen or phosphorus as the adsorptive group, preferred structures can be represented by the general formula (X).

$(P\text{-}Q_1\text{-})_i\text{-}R(\text{-}Q_2\text{-}S)_j$ General formula (X)

In the general formula (X), each of P and R independently represents the structure of quaternary salt of nitrogen or phosphorus, which is not a partial structure of sensitizing dye. Each of $Q_1$ and $Q_2$ independently represents a linking group, which may be, for example, a single bond, an alkylene group, an arylene group, a heterocyclic group, —O—, —S—, —$NR_N$—, —C(═O)—, —$SO_2$—, —SO— and —P(═O)—, these used individually or in combination. $R_N$ represents a hydrogen atom, an alkyl group, an aryl group or a heterocyclic group. S represents a residue resulting from removal of one atom from the compound of type 1 or type 2. Each of i and j is an integer of 1 or greater, provided that i+j is in the range of 2 to 6. i=1 to 3 while j=1 to 2 is preferred, i=1 or 2 while j=1 is more preferred, and i=j=1 is most preferred. With respect to the compounds represented by the general formula (X), the total number of carbon atoms thereof is preferably in the range of 10 to 100, more preferably 10 to 70, still more preferably 11 to 60, and most preferably 12 to 50.

Specific examples represented by type 1 and type 2 will be shown below, which however in no way limit the scope of the invention.

1

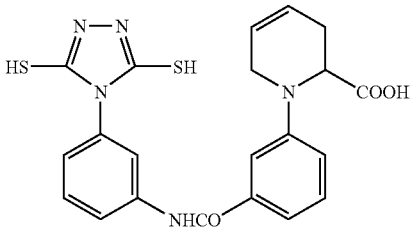

2

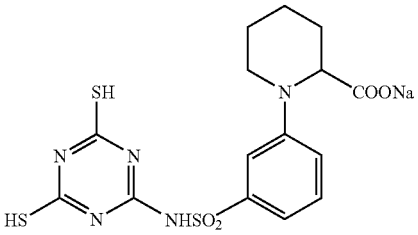

3

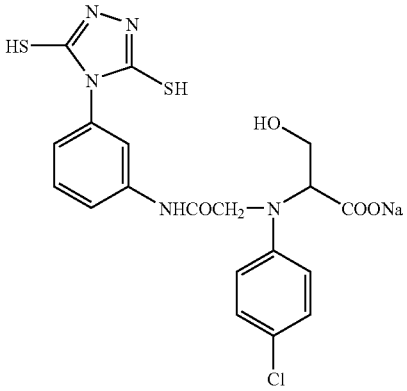

4

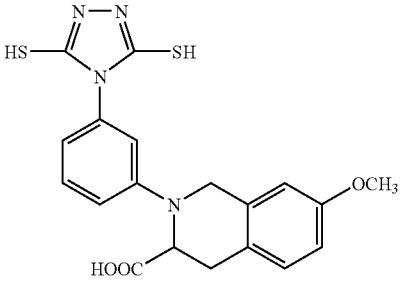

5

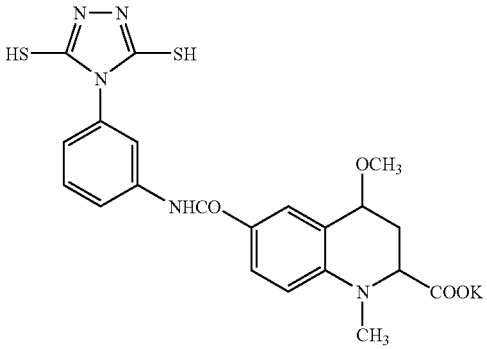

6

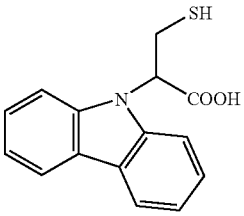

7

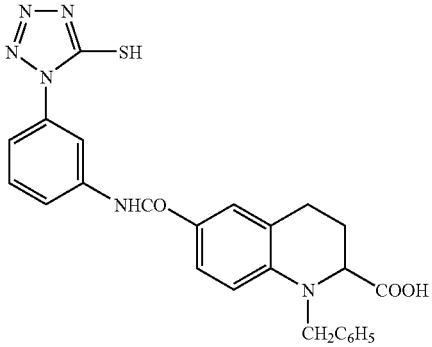

8

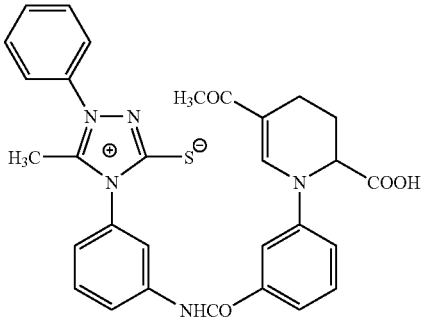

-continued
9
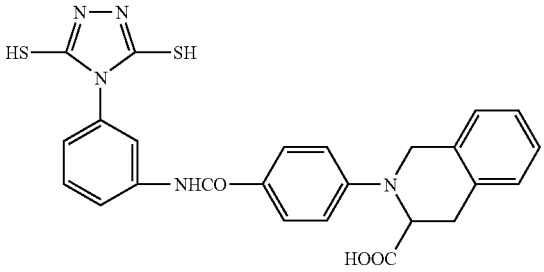
10
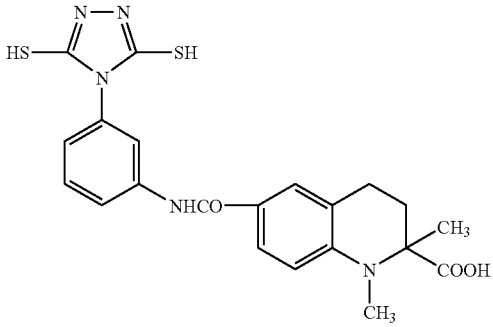
11
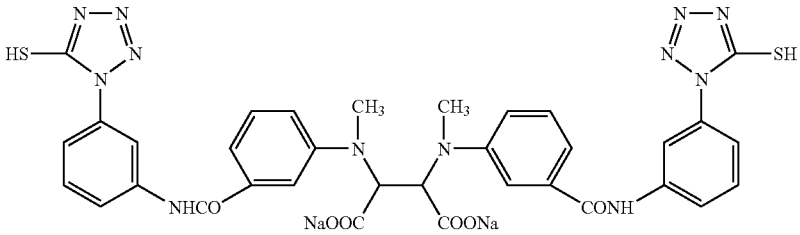
12
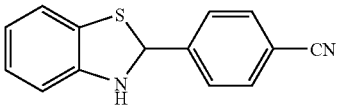
13
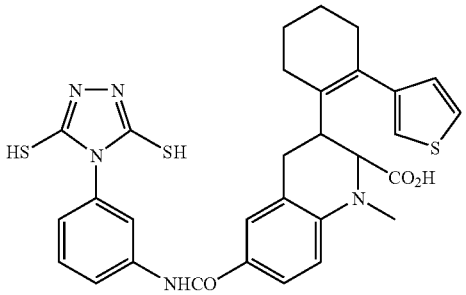
14
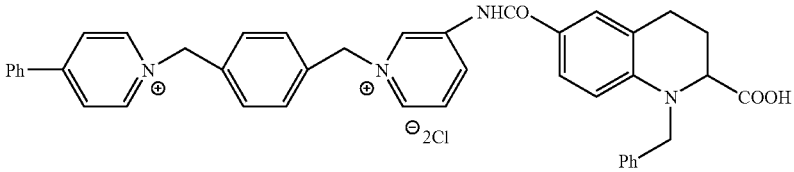
15
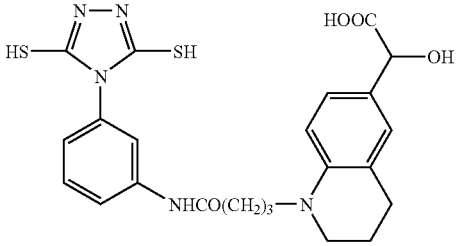
16
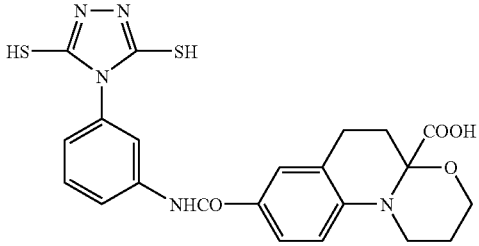

-continued
17
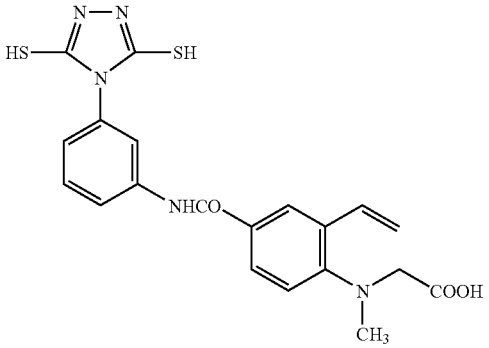
18
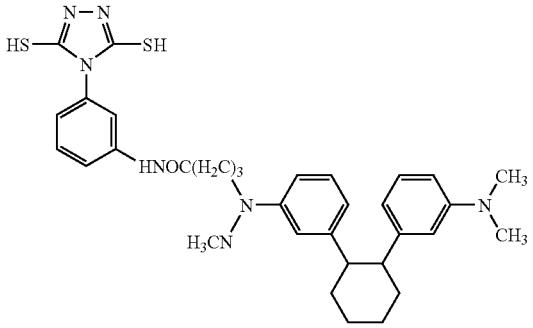
19
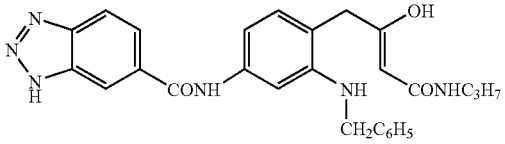
20
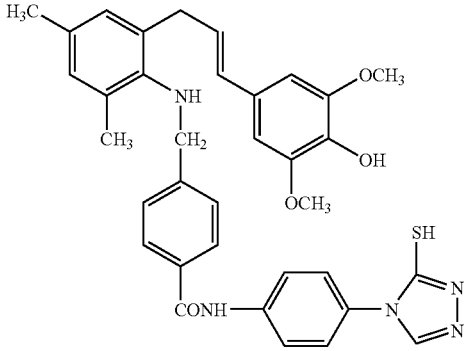
21
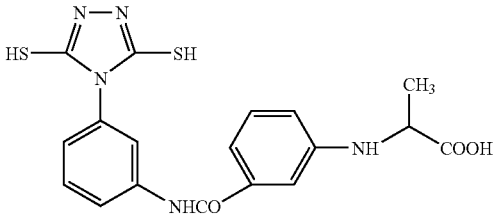
22
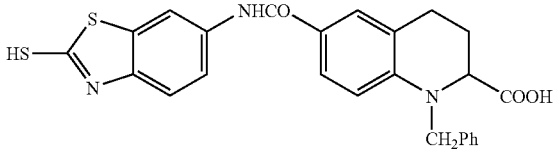
23
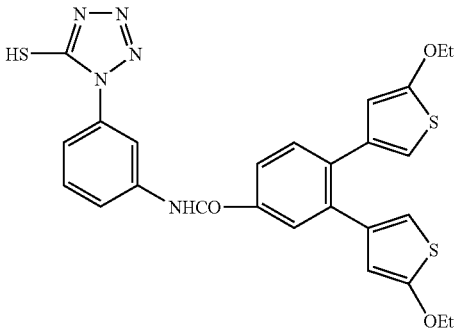

-continued
24
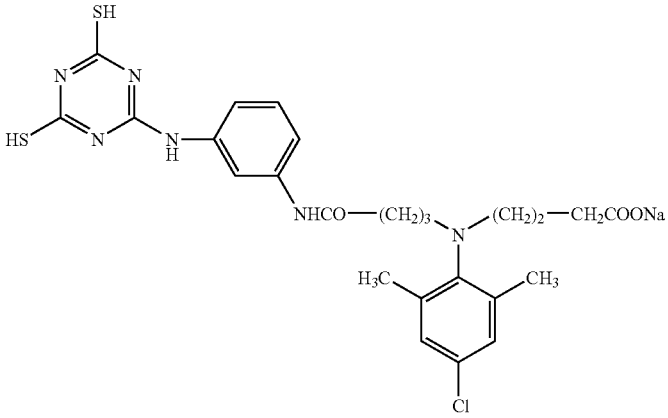
25
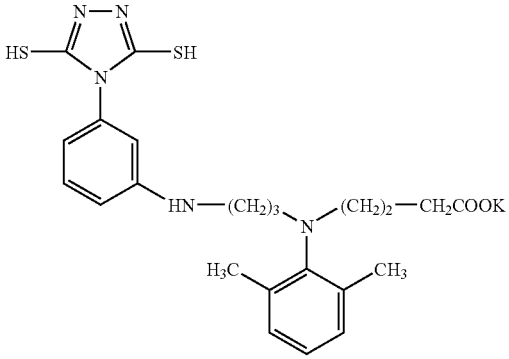
26
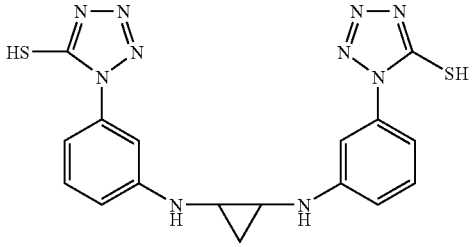
27
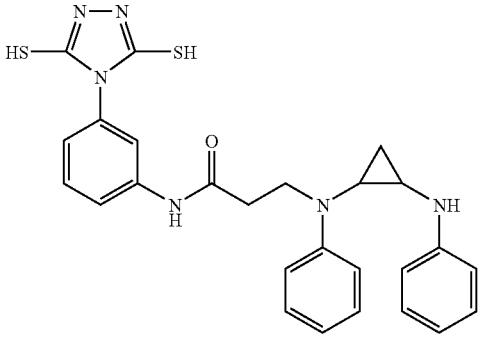
28
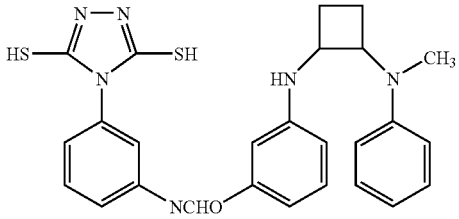
29
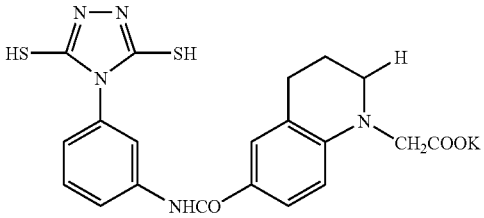
30
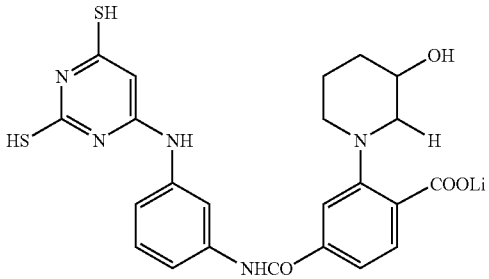

-continued
31
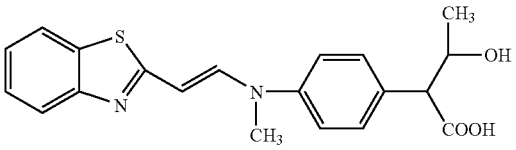
32
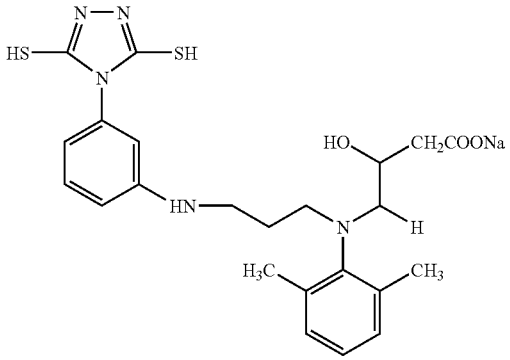
33
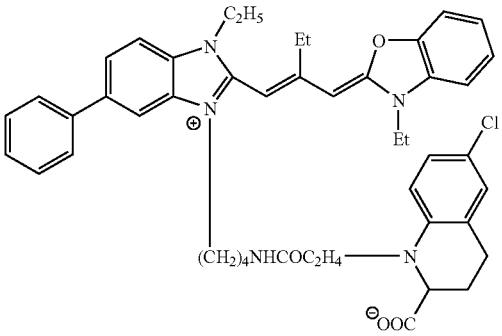
34
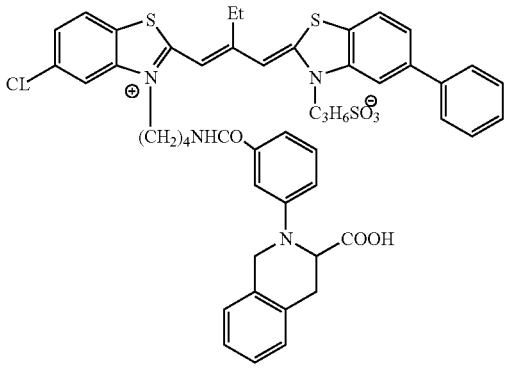
35
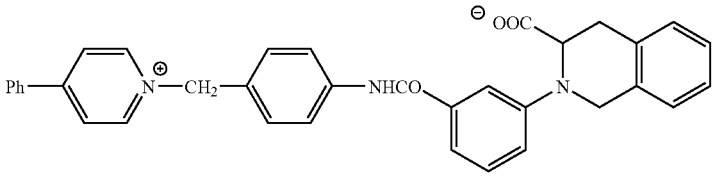
36
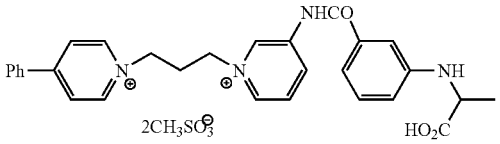
37
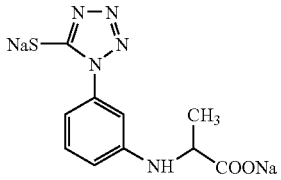
38
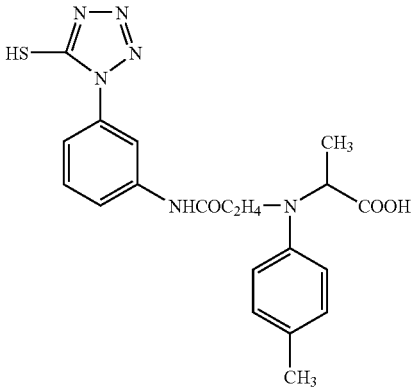
39
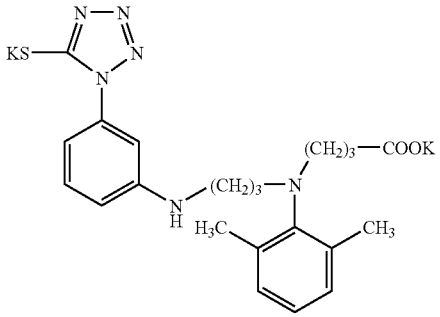

-continued
40
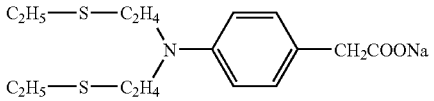
41
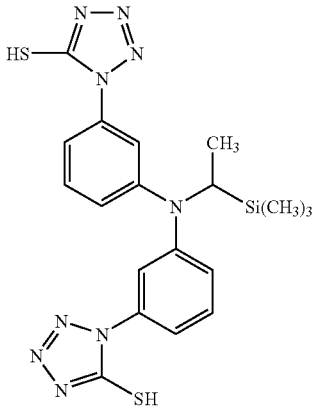
42
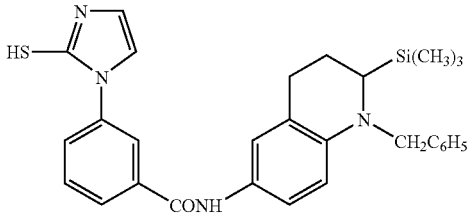
43
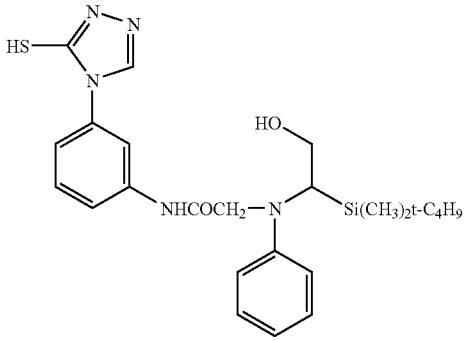
44
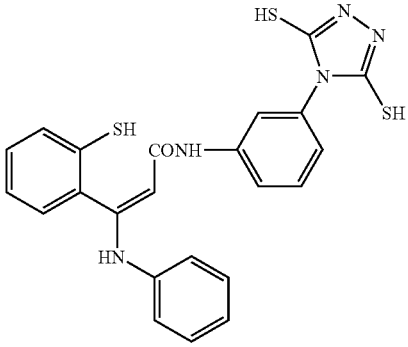
45
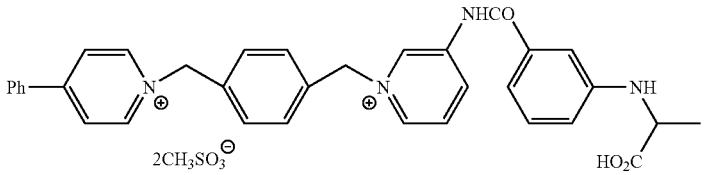
46
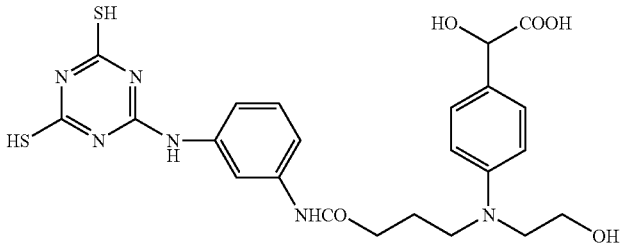

-continued

47

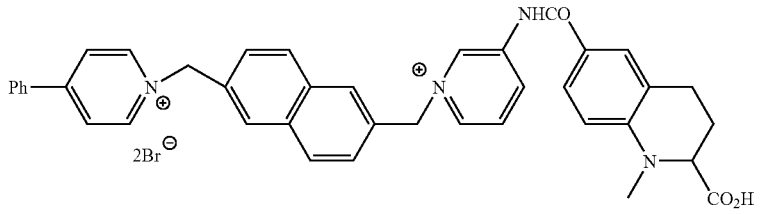

The compounds of type 1 and type 2 according to the present invention may be added at any stage during the emulsion preparation or photosensitive material production. For example, the addition may be effected at grain formation, desalting, chemical sensitization or coating. The compounds may be divided and added in multiple times during the above stages. The addition stage is preferably after completion of grain formation but before desalting, during chemical sensitization (just before initiation of chemical sensitization to just after termination thereof) or prior to coating. The addition stage is more preferably during chemical sensitization or prior to coating.

The compounds of type 1 and type 2 according to the present invention are preferably dissolved in water, a water soluble solvent such as methanol or ethanol or a mixed solvent thereof before addition. In the dissolving in water, with respect to compounds whose solubility is higher at higher or lower pH value, the dissolution is effected at pH value raised or lowered before addition.

The compounds of type 1 and type 2 according to the present invention, although preferably incorporated in emulsion layers, may be added to not only an emulsion layer but also a protective layer or an interlayer so as to realize diffusion at the time of coating operation. The timing of addition of compounds of the present invention may be before or after sensitizing dye addition, and at either stage the compounds are preferably incorporated in silver halide emulsion layers in an amount of $1\times10^{-9}$ to $5\times10^{-2}$ mol, more preferably $1\times10^{-8}$ to $2\times10^{-3}$ mol per mol of silver halides.

The present invention is preferably used in combination with the technique of increasing a light absorption with a spectral sensitizing dye, more preferably the technique of multilayer adsorption of sensitizing dye. The multilayer adsorption refers to adsorption (or laminating) of more than one layer of dye chromophore on the surface of silver halide grains.

The multilayer adsorption can be effected by, for example, the method of effecting adsorption of sensitizing dyes on the surface of silver halide grains in an amount greater than monolayer saturated coating amount by the use of intermolecular force, or the method of effecting adsorption on silver halide grains of a dye consisting of two or more separate nonconjugated dye chromophores coupled with each other through covalent bond, known as coupled dye. The particulars thereof are described in the following patents relating to multilayer adsorption.

JP-A's-10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173 and 2001-350442, and EP's 985965A, 985964A, 985966A, 985967A, 1085372A, 1085373A, 1172688A, 1199595A and 887700A1.

Moreover, the present invention is preferably used in combination with techniques described in JP-A's-10-239789, 2001-75222 and 10-171058.

The photosensitive material to which the method of the present invention can be applied is not limited as long as it comprises a support and, superimposed thereon, a blue-sensitive layer composed of at least one silver halide emulsion layer, a green-sensitive layer unit composed of at least two silver halide emulsion layers, a red-sensitive layer unit composed of at least two silver halide emulsion layers and at least one non-light-sensitive layer. Preferably, the photosensitive material comprises color-sensitive layer units respectively sensitive to blue, green and red, each of which is composed of at least two silver halide emulsion layers, and at least one non-light-sensitive layer. The color-sensitive layer units are those each having sensitivity to any of blue light, green light and red light. In the present invention, the arrangement of color-sensitive layer units is preferably such that the red-sensitive layer unit, the green-sensitive layer unit and the blue-sensitive layer unit are disposed in sequence from the support side. However, according to any intended use, this arrangement order may be reversed, or an arrangement order can be employed in which in a given color-sensitive unit, a silver halide emulsion layer having different color sensitivity is interposed between layers of the unit. Non-light-sensitive layers may be provided between color-sensitive layer units or as the uppermost layer or lowermost layer thereof. In the present invention, it is preferred that non-light-sensitive layers be provided as the uppermost layer or lowermost layer of color-sensitive units. These may contain, e.g., couplers, DIR compounds and color mixing inhibitors described later. With respect to multiple silver halide emulsion layers constituting each color-sensitive layer unit, it is preferred that two layers consisting of a high-speed emulsion layer and a low-speed emulsion layer be arranged so that the photosensitivity is sequentially decreased toward the support, as described in DE 1,121,470 or GB 923,045. Also, as described in JP-A's-57-112751, 62-200350, 62-206541 and 62-206543, layers can be arranged so that a low-speed emulsion layer is disposed on a side remote from a support while a high-speed emulsion layer is disposed on a side close to the support.

More specifically, layers can be arranged, from the one farthest from a support, in the order of a low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in JP-B-55-34932, the disclosure of which is incorporated herein by reference, layers can be arranged in the order of a blue-sensitive layer/GH/RH/GL/

RL from the one farthest from a support. Furthermore, as described in JP-A's-56-25738 and 62-63936, the disclosures of which are incorporated herein by reference, layers can be arranged in the order of a blue-sensitive layer/GL/RL/GH/RH from the one farthest from a support.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. Even when a layer structure is thus constituted by three layers having different sensitivities, these layers can be arranged, in a layer sensitive to one color, in the order of a medium-speed emulsion layer/high-speed emulsion layer/low-speed emulsion layer from the one farthest from a support as described in JP-A-59-202464, the disclosure of which is incorporated herein by reference.

In addition, the order of a high-speed emulsion layer/low-speed emulsion layer/medium-speed emulsion layer or low-speed emulsion layer/medium-speed emulsion layer/high-speed emulsion layer can be used.

Furthermore, the arrangement can be changed as described above even when four or more layers are formed.

Preferred silver halides for use in the present invention are a silver iodobromide, silver iodochloride or silver iodochlorobromide containing about 30 mol % or less of silver iodide. Especially preferred silver halides are a silver iodobromide or silver iodochlorobromide containing about 2 to about 10 mol % of silver iodide.

Silver halide grains contained in each photographic emulsion may be those having regular crystals such as cubic, octahedral or tetradecahedral crystals, those having irregular crystal form such as spherical or tabular crystal form, those having crystal defects such as twin planes, or composite forms thereof.

The silver halide grains may consist of fine grains having a grain diameter of about 0.2 μm or less, or large grains having a projected area diameter of up to about 10 μm. The emulsion may be a polydisperse emulsion or monodisperse emulsion.

The silver halide photographic emulsion which can be used in the present invention can be prepared by methods described in, e.g., Research Disclosure (hereinafter referred to as RD) No. 17643 (December, 1978), pp. 22 and 23, "I. Emulsion preparation and types"; RD No. 18716 (November, 1979), page 648; RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

It is also preferred to use monodisperse emulsions described in U.S. Pat. Nos. 3,574,628 and 3,655,394 and GB 1,413,748.

Tabular grains of about 3 or higher aspect ratio can especially preferably used in the present invention. Such tabular grains can be easily prepared by the processes described in Gutoff, Photographic Science and Engineering, Vol. 14, pp. 248-257 (1970), U.S. Pat. Nos. 4,434,226, 4,414,310, 4,433,048 and 4,439,520 and GB 2,112,157.

It has been found that the compound capable of improving the sensitivity/graininess ratio according to the present invention exerts especially striking effect when used in layers wherein tabular grains of 8 or higher average aspect ratio are simultaneously present. The average aspect ratio thereof is preferably in the range of 8 to 100, more preferably 12 to 50.

The crystal structure can be uniform, can consist of halogen compositions which are different between the inner part and the outer part thereof, or can be a layered structure. Alternatively, the crystal structure can be such that silver halides of different compositions couple with each other through epitaxial junction, or can be such that silver halides couple with a compound other than silver halide, such as silver rhodanide or lead oxide. Also, use can be made of a mixture of grains having various crystal forms.

It is preferred that the above emulsions have dislocation. In particular, with respect to tabular grains, it is preferred that dislocation be present at fringes thereof. In the introduction of dislocation, use can be made of, for example, the method in which an aqueous solution of alkali iodide or the like is added so as to form a layer of high silver iodide content, or the method in which fine grains of AgI are added, or the method of JP-A-5-323487.

An emulsion described above can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on the development conditions and the like, it is preferably 3 to 40 nm, and most preferably, 5 to 20 nm.

A silver halide emulsion is normally subjected to physical ripening, chemical sensitization, and spectral sensitization before being used. Additives for use in these steps are described in Research Disclosure (RD) Nos. 17643, 18716, and 307105, and the corresponding portions are summarized in a table to be presented later.

In a light-sensitive material of the present invention, it is possible to mix, in a single layer, two or more types of emulsions different in at least one of the characteristics, i.e., the grain size, grain size distribution, halogen composition, grain shape, and sensitivity, of a sensitive silver halide emulsion.

It is also preferable to apply surface-fogged silver halide grains described in U.S. Pat. No. 4,082,553, internally fogged silver halide grains described in U.S. Pat. No. 4,626,498 and JP-A-59-214852, and colloidal silver, to light-sensitive silver halide emulsion layers and/or substantially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852. A silver halide which forms the core of the internally fogged core/shell type silver halide grain can have a different halogen composition. As the internally fogged or surface-fogged silver halide, any of silver chloride, silver chlorobromide, silver iodobromide, and silver bromochloroiodide can be used. The average equivalent-sphere diameter of these fogged silver halide grains is preferably 0.01 to 0.75 μm, and most preferably, 0.05 to 0.6 μm. The grain shape can be a regular grain shape. Although the emulsion can be a polydisperse emulsion, it is preferably a monodisperse emulsion (in which at least 95% in weight, or number, of silver halide grains have grain sizes falling within the range of ±40% of the average grain size).

In the present invention, a non-light-sensitive fine-grain silver halide is preferably used. The non-light-sensitive fine-grain silver halide preferably consists of silver halide grains which are not exposed during imagewise exposure for obtaining a dye image and are not substantially developed during development. These silver halide grains are preferably not fogged in advance. In the fine-grain silver halide, the content of silver bromide is 0 to 100 mol %, and silver chloride and/or silver iodide can be added if necessary. The fine-grain silver halide preferably contains 0.5 to 10 mol % of silver iodide. The average grain size (the average value of equivalent-circle diameters of projected areas) of the fine-grain silver halide is preferably 0.01 to 0.5 μm, and more preferably, 0.02 to 0.2 μm.

The fine-grain silver halide can be prepared following the same procedures as for a common light-sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine-grain silver halide grain-containing layer.

A coating silver amount of the light-sensitive material of the present invention is preferably 8.0 g/m$^2$ or less.

Photographic additives usable in the present invention are also described in RD's, the disclosures of which are incorporated herein by reference, and the relevant portions are summarized in the following table.

| | Types of Additives | RD17643 | RD18716 | RD307105 |
|---|---|---|---|---|
| 1. | Chemical sensitizers | page 23 | page 648 right column | page 866 |
| 2. | Sensitivity increasing agents | | page 648 right column | |
| 3. | Spectral sensitizers, super sensitizers | pages 23-24 | page 648, right column to page 649, right column | pages 866-868 |
| 4. | Brighteners | page 24 | page 647, right column | page 868 |
| 5. | Light absorbents, filter dyes, ultraviolet absorbents | pages 25-26 | page 649, right column to page 650, left column | page 873 |
| 6. | Binders | page 26 | page 651, left column | pages 873-874 |
| 7. | Plasticizers, lubricants | page 27 | page 650, right column | page 876 |
| 8. | Coating aids, surfactants | pages 26-27 | page 650, right column | pages 875-876 |
| 9. | Antistatic agents | page 27 | page 650, right column | pages 876-877 |
| 10. | Matting agents | | | pages 878-879. |

Various dye forming couplers can be used in the photosensitive material of the present invention, and the following couplers are particularly preferable.

Yellow couplers: couplers represented by formulae (I) and (II) in EP No. 502,424A; couplers represented by formulae (1) and (2) in EP No. 513,496A (particularly Y-28 on page 18); a coupler represented by formula (I) in claim 1 of EP No. 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP No. 498,381A1 (particularly D-35 on page 18); couplers represented by formula (Y) on page 4 in EP No. 447,969A1 (particularly Y-1 (page 17) and Y-54 (page 41)); and couplers represented by formulae (II) to (IV) in column 7, lines 36 to 58, in U.S. Pat. No. 4,476,219 (particularly II-17, II-19 (column 17), and II-24 (column 19)), the disclosures of the above documents disclosing the yellow couplers are incorporated herein by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and -75 (page 139) in EP No. 456,257; M-4 and -6 (page 26), and M-7 (page 27) in EP No. 486,965; M-45 (page 19) in EP No. 571,959A; (M–1) (page 6) in JP-A-5-204106; and M-22 in paragraph 0237 of JP-A-4-362631, the disclosures of the above documents disclosing the magenta couplers are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (1-1) and (1-17) (pages 42 and 43) in JP-A-4-43345; and couplers represented by general formulae (Ia) and (Ib) in claim 1 of JP-A-6-67385, the disclosures of the above documents disclosing the cyan couplers are incorporated herein by reference.

Polymer couplers: P-1 and P-5 (page 11) in JP-A-2-44345, the disclosure of which is incorporated herein by reference.

Couplers for producing a color forming dye with a proper diffusibility are preferably those described in U.S. Pat. No. 4,366,237, GB 2,125,570, EP 96873B and DE 3,234,533.

As couplers for correcting the unnecessary absorption of a color forming dye, preferred use is made of yellow colored cyan couplers represented by formulas (CI), (CII), (CIII) and (CIV) described on page 5 in EP 456257A1 (particularly YC-86 on page 84); yellow colored magenta couplers ExM-7 (page 202), Ex-1 (page 249) and EX-7 (page 251) described in EP 456257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers represented by formula (A) in claim 1 of WO 92/11575 (particularly compound examples on pages 36 to 45).

Examples of compounds (including couplers) which react with a developing agent oxidation product to thereby release a photographically useful compound residue are as follows. Development inhibitor release compounds: compounds represented by formulas (I), (II), (III) and (IV) on page 11 of EP 378236A1 (particularly T-101 (page 30), T-104 (page 31), T-113 (page 36), T-131 (page 45), T-144 (page 51) and T-158 (page 58)); compounds represented by formula (I) on page 7 of EP 436938A2 (particularly D-49 (page 51)); compounds represented by formula (1) in EP 568037A (particularly (23) (page 11)); and compounds represented by formulas (I), (II) and (III) on pages 5 and 6 of EP 440195A2 (particularly 1-(1) on page 29). Bleaching accelerator release compounds: compounds represented by formulas (I) and (I') on page 5 of EP 310125A2 (particularly (60) and (61) on page 1); and compounds represented by formula (I) in claim 1 of JP-A-6-59411 (particularly (7) (page 7)). Ligand release compounds: compounds represented by LIG-X described in claim 1 of U.S. Pat. No. 4,555,478 (particularly compounds in column 12, lines 21 to 41). Leuco dye release compounds: compounds 1 to 6 in columns 3 to 8 of U.S. Pat. No. 4,749,641. Fluorescent dye release compounds: compounds represented by COUP-DYE in claim 1 of U.S. Pat. No. 4,774,181 (particularly compounds 1 to 11 in columns 7 to 10). Development accelerator or fogging agent release compounds: compounds represented by formulas (1), (2) and (3) in column 3 of U.S. Pat. No. 4,656,123 (particularly (1-22) in column 25); and ExZK-2 on page 75, lines 36 to 38, in EP 450637A2. Compounds which release a group which does not function as a dye unless it splits off: compounds represented by formula (I) in claim 1 of U.S. Pat. No. 4,857,447 (particularly Y-1 to Y-19 in columns 25 to 36).

Preferable examples of additives other than couplers are as follows.

Dispersion mediums of an oil-soluble organic compound: P-3, P-5, P-16, P-19, P-25, P-30, P-42, P-49, P-54, P-55, P-66, P-81, P-85, P-86 and P-93 (pages 140 to 144) in JP-A-62-215272. Latexes for impregnation of an oil-soluble organic compound: latexes described in U.S. Pat. No. 4,199,363. Developing agent oxidation product scavengers: compounds represented by formula (I) in column 2, lines 54 to 62, in U.S. Pat. No. 4,978,606 (particularly 1-(1), 1-(2), 1-(6) and 1-(12) (columns 4 and 5)) and formulas in column 2, lines 5 to 10, in U.S. Pat. No. 4,923,787 (particularly compound 1 (column 3)). Stain inhibitors: formulas (I) to (III) on page 4, lines 30 to 33, particularly I-47, I-72, III-1 and III-27 (pages 24 to 48) in EP 298321A. Discoloration inhibitors: A-6, A-7, A-20, A-21, A-23, A-24, A-25, A-26, A-30, A-37, A-40, A-42, A-48, A-63, A-90, A-92, A-94 and A-164 (pages 69 to 118) in EP 298321A; II-1 to III-23, particularly III-10, in columns 25 to 38 of U.S. Pat. No. 5,122,444; I-1 to III-4, particularly II-2, on pages 8 to 12 in EP 471347A; and A-1 to A-48, particularly A-39 and A-42, in columns 32 to 40 of U.S. Pat. No. 5,139,931. Materials capable of reducing the use amount of a color enhancer or a color mixing inhibitor: I-1 to II-15, particularly I-46, on pages 5 to 24 in EP 411324A. Formalin scavengers: SCV-1 to SCV-28, particularly SCV-8, on pages 24 to 29 in EP 477932A. Film hardeners: H-1, H-4, H-6, H-8 and H-14 on page 17 in JP-A-1-214845; compounds (H-1 to H-54) represented by formulas (VII) to (XII) in columns 13 to 23 of U.S. Pat. No. 4,618,573; compounds (H-1 to H-76), particularly H-14, represented by formula (6) on page 8, right lower column, in JP-A-2-214852; and compounds described in claim 1 of U.S. Pat. No. 3,325,287. Development inhibitor precursors: P-24, P-37 and P-39 (pages 6 and 7) in JP-A-62-168139; and compounds described in claim 1, particularly 28 and 29 in column 7, of U.S. Pat. No. 5,019,492. Antiseptic agents and mildewproofing agents; I-1 to III-43, particularly II-1, II-9, II-10, II-18 and III-25, in columns 3 to 15 of U.S. Pat. No. 4,923,790. Stabilizers and antifoggants: I-1 to (14), particularly I-1, I-60, (2) and (13), in columns 6 to 16 of U.S. Pat. No. 4,923,793; and compounds 1 to 65, particularly compound 36, in columns 25 to 32 of U.S. Pat. No. 4,952,483. Chemical sensitizers: triphenylphosphine selenide and compound 50 in JP-A-5-40324. Dyes: a-1 to b-20, particularly a-1, a-12, a-18, a-27, a-35, a-36 and b-5, on pages 15 to 18 and V-1 to V-23, particularly V-1, on pages 27 to 29 in JP-A-3-156450; F-1-1 to F-II-43, particularly F-1-11 and F-II-8, on pages 33 to 55 in EP 445627A; III-1 to III-36, particularly III-1 and III-3, on pages 17 to 28 in EP 457153A; microcrystalline dispersions of Dye-1 to Dye-124 on pages 8 to 26 in WO 88/04794; compounds 1 to 22, particularly compound 1, on pages 6 to 11 in EP 319999A; compounds D-1 to D-87 (pages 3 to 28) represented by formulas (1) to (3) in EP 519306A; compounds 1 to 22 (columns 3 to 10) represented by formula (I) in U.S. Pat. No. 4,268,622; and compounds (1) to (31) (columns 2 to 9) represented by formula (I) in U.S. Pat. No. 4,923,788. UV absorbents: compounds (18b) to (18r) and 101 to 427 (pages 6 to 9) represented by formula (1) in JP-A-46-3335; compounds (3) to (66) (pages 10 to 44) represented by formula (I) and compounds HBT-1 to HBT-10 (page 14) represented by formula (III) in EP 520938A; and compounds (1) to (31) (columns 2 to 9) represented by formula (1) in EP 521823A.

The present invention can be applied to various color photosensitive materials such as color negative films for general purposes or cinemas, color reversal films for slides and TV, color paper, color positive films and color reversal paper. Moreover, the present invention is suitable to lens equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

The specified photographic speed referred to in the present invention is determined by the method described in JP-A-63-236035. The determining method is substantially in accordance with JIS K 7614-1981 except that the development processing is completed within 30 min to 6 hr after exposure for sensitometry and that the development processing is performed according to Fuji Color standard processing recipe CN-16.

In the photosensitive material of the present invention, the thickness of photosensitive silver halide layer closest to the support through surface of the photosensitive material is preferably 24 μm or less, more preferably 22 μm or less. Film swelling speed $T_{1/2}$ is preferably 30 sec or less, more preferably 20 sec or less. The film swelling speed $T_{1/2}$ is defined as the time that when the saturation film thickness refers to 90% of the maximum swollen film thickness attained by the processing in a color developer at 30° C. for 3 min 15 sec, is spent for the film thickness to reach ½ of the saturation film thickness. The film thickness means one measured under moisture conditioning at 25° C. in a relative humidity of 55% (two days). The film swelling speed $T_{1/2}$ can be measured by using a swellometer described in A. Green et al., Photogr. Sci. Eng., Vol. 19, No. 2, pp. 124 to 129. The film swelling speed $T_{1/2}$ can be regulated by adding a film hardener to gelatin as a binder, or by changing aging conditions after coating. The swelling ratio preferably ranges from 150 to 400%. The swelling ratio can be calculated from the maximum swollen film thickness measured under the above conditions in accordance with the formula:

$$(\text{maximum swollen film thickness} - \text{film thickness})/\text{film thickness}.$$

In the light-sensitive material of the present invention, hydrophilic colloid layers (referred to as "back layers") having a total dry film thickness of 2 to 20 μm are preferably provided on the side opposite to the side having emulsion layers. These back layers preferably contain the aforementioned light absorbent, filter dye, ultraviolet absorbent, antistatic agent, film hardener, binder, plasticizer, lubricant, coating aid and surfactant. The swelling ratio of these back layers is preferably in the range of 150 to 500%.

The light-sensitive material according to the present invention can be developed by conventional methods described in the aforementioned RD. No. 17643, pages 28 and 29; RD. No. 18716, page 651, left to right columns; and RD No. 307105, pages 880 and 881.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol, and most preferably 0.02 to 0.05 mol per liter (hereinafter also referred to as "L") of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as a preservative of the color developing solution. When enhanced preserving properties are required, it is preferred to use hydroxylamine derivatives having substituents such as alkyl, hydroxyalkyl, sulfoalkyl and carboxyalkyl groups. Preferred examples thereof include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl) hydroxylamine is most preferred. Although these may be used in combination with hydroxylamine, it is preferred that one or two or more members thereof be used in place of hydroxylamine.

These preservatives are preferably used in an amount of 0.02 to 0.2 mol, more preferably 0.03 to 0.15 mol, and most preferably 0.04 to 0.1 mol per L of the color developing solution. The replenisher of the color developing solution preferably contains the preservatives in an amount corresponding to 1.1 to 3 times the concentration of the mother liquor (processing tank solution) as in the color developing agent.

Sulfurous salts are used as tarring preventives for the color developing agent oxidation products in the color developing solution. Sulfurous salts are preferably used in the color developing solution in an amount of 0.01 to 0.05 mol, more preferably 0.02 to 0.04 mol per L. In the replenisher, sulfurous salts are preferably used in an amount corresponding to 1.1 to 3 times the above concentration.

The pH value of the color developing solution preferably ranges from 9.8 to 11.0, more preferably from 10.0 to 10.5. The pH of the replenisher is preferably set for a value 0.1 to 1.0 higher than the above value. Common buffers, such as carbonic acid salts, phosphoric acid salts, sulfosalicylic acid salts and boric acid salts, are used for stabilizing the above pH value.

Although the amount of the replenisher of the color developing solution preferably ranges from 80 to 1300 mL per $m^2$ of the lightsensitive material, the employment of smaller amount is desirable from the viewpoint of reduction of environmental pollution load. Specifically, the amount of the replenisher more preferably ranges from 80 to 600 mL, most preferably from 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. If C represented by formula below takes a negative value, however, no bromide ions are preferably added to a replenisher.

$$C=A-W/V$$

where

C: the bromide ion concentration (mol/L) in a color developer replenisher

A: the target bromide ion concentration (mol/L) in a color developer

W: the amount (mol) of bromide ions dissolving into the color developer from 1 $m^2$ of a light-sensitive material when the sensitive material is color-developed V: the replenishment rate (L) of the color developer replenisher for 1 $m^2$ of the light-sensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Compounds and processing conditions described on page 4, left lower column, line 16 to page 7, left lower column, line 6 of JP-A-4-125558 can be applied to the processing solution having bleaching capability for use in the present invention.

Bleaching agents having redox potentials of at least 150 mV are preferably used. Specifically, suitable examples thereof are those described in JP-A-5-72694 and JP-A-5-173312, and especially suitable examples thereof are 1,3-diaminopropanetetraacetic acid, Example 1 compounds listed on page 7 of JP-A-5-173312 and ferric complex salts.

For improving the biodegradability of bleaching agent, it is preferred that ferric complex salts of compounds listed in JP-A-4-251845, JP-A-4-268552, EP 588289, EP 591934 and JP-A-6-208213 be used as the bleaching agent. The concentration of these bleaching agents preferably ranges from 0.05 to 0.3 mol per liter of solution having bleaching capability, and it is especially preferred that a design be made at 0.1 to 0.15 mol per liter for the purpose of reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally at a concentration calculated by the following formula. This enables keeping the concentration in the mother liquor constant.

$$C_R=C_T\times(V_1+V_2)/V_1+C_P$$

$C_R$: concentration of each component in the replenisher, $C_T$: concentration of the component in the mother liquor (processing tank solution), $C_P$: component concentration consumed during processing, $V_1$: amount of replenisher having bleaching capability supplied per $m^2$ of photosensitive material (mL), and $V_2$: amount carried from previous bath by 1 $m^2$ of photosensitive material (mL).

In addition, a pH buffer is preferably incorporated in the bleaching solution, and it is especially preferred to incorporate a dicarboxylic acid of low order such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and most preferably 100 to 300 mL of a bleaching replenisher per $m^2$ of photosensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of not only p-toluenesulfinic salts but also sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the desilvering, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and more preferably 200 to 600 mL per $m^2$ of the photosensitive material.

Silver is preferably recovered by installing any of various silver recovering devices in an in-line or off-line mode in the bleach-fix or fixation step. In-line installation enables processing with the silver concentration of solution lowered, so that the amount of replenisher can be reduced. It is also suitable to conduct an off-line silver recovery and recycle residual solution for use as a replenisher.

The bleach-fix and fixation steps can each be accomplished by the use of multiple processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to the washing and stabilization steps. In particular, with respect to the stabilizing solution, the use of azolylmethylamines described in EP 504609 and EP 519190 and N-methylolazoles described in JP-A-4-362943 in place of formaldehyde and the conversion of magenta coupler to two-equivalent form so as to obtain a surfactant solution not containing any image stabilizer such as formaldehyde are preferred from the viewpoint of protecting working environment.

Further, stabilizing solutions described in JP-A-6-289559 can preferably be used for reducing the adhesion of refuse to a magnetic recording layer applied to the photosensitive material.

The replenishing amount of washing and stabilizing solutions is preferably in the range of 80 to 1000 mL, more preferably 100 to 500 mL, and most preferably 150 to 300 mL, per $m^2$ of the photosensitive material from the viewpoint that washing and stabilizing functions are ensured and that the amount of waste solution is reduced to contribute to environment protection. In the processing conducted with the above replenishing amount, known mildewproofing agents such as thiabendazole, 1,2-benzoisothiazolin-3-one and 5-chloro-2-methylisothiazolin-3-one, antibiotics such as gentamicin, and water deionized by the use of, for example, an ion exchange resin are preferably used for preventing the breeding of bacteria and mildew. The joint use of deionized water, a mildewproofing agent and an antibiotic is more effective than single use thereof.

With respect to the solution placed in the washing or stabilizing solution tank, it is also preferred that the replenishing amount be reduced by conducting a reverse osmosis membrane treatment as described in JP-A's-3-46652, 3-53246, 3-55542, 3-121448 and 3-126030. A low-pressure reverse osmosis membrane is preferably used as the reverse osmosis membrane of the above treatment.

In the processing of the present invention, it is especially preferred that an evaporation correction of processing solution be carried out as disclosed in JIII (Japan Institute of Invention and Innovation) Journal of Technical Disclosure No. 94-4992. In particular, the method in which a correction is effected with the use of information on the temperature and humidity of developing machine installation environment in accordance with Formula 1 on page 2 thereof is preferred. Water for use in the evaporation correction is preferably procured from the washing replenishing tank. In that instance, deionized water is preferably used as the washing replenishing water.

Processing agents set forth on page 3, right column, line 15 to page 4, left column, line 32 of the above journal of technical disclosure are preferably used in the present invention. Film processor described on page 3, right column, lines 22 to 28 thereof is preferably used as the developing machine in the processing of the present invention.

Specific examples of processing agents, automatic developing machines and evaporation correction schemes preferably employed in carrying out of the present invention are described on page 5, right column, line 11 to page 7, right column, last line of the above journal of technical disclosure.

The processing agent for use in the present invention may be supplied in any form, for example, form of a liquid agent with the same concentration as in use or concentrated one, granules, powder, tablets, a paste or an emulsion. For example, a liquid agent stored in a container of low oxygen permeability is disclosed in JP-A-63-17453, vacuum packed powder or granules in JP-A's-4-19655 and 4-230748, granules containing a water soluble polymer in JP-A-4-221951, tablets in JP-A's-51-61837 and 6-102628 and a paste processing agent in PCT National Publication 57-500485. Although any of these can be suitably used, from the viewpoint of easiness in use, it is preferred to employ a liquid prepared in the same concentration as in use in advance.

Any one or a composite of polyethylene, polypropylene, polyvinyl chloride, polyethylene terephthalate, nylon, etc. is molded into the container for storing the above processing agents. These materials are selected in accordance with the required level of oxygen permeability. A material of low oxygen permeability is preferably used for storing an easily oxidized liquid such as a color developing solution, which is, for example, polyethylene terephthalate or a composite material of polyethylene and nylon. It is preferred that each of these materials be used in the container at a thickness of 500 to 1500 μm so that the oxygen permeability therethrough is 20 $mL/m^2 \cdot 24$ hrs·atm or less.

The processing solution for color reversal film to be employed in the present invention will be described below.

With respect to the processing of color reversal film, detailed descriptions are made in Public Technology No. 6 (Apr. 1, 1991) issued by Aztek, page 1, line 5 to page 10, line 5 and page 15, line 8 to page 24, line 2, any of which can be preferably applied thereto.

In the processing of color reversal film, an image stabilizer is added to a conditioning bath or a final bath. Examples of suitable image stabilizers include formalin, formaldehyde sodium bisulfite and N-methylolazoles. Formaldehyde sodium bisulfite and N-methylolazoles are preferred from the viewpoint of working environment, Among the N-methylolazoles, N-methyloltriazole is especially preferred. The contents of descriptions on color developing solution, bleaching solution, fixing solution, washing water, etc. made in connection with the processing of color negative films are also preferably applicable to the processing of color reversal films.

Processing agent E-6 available from Eastman Kodak and processing agent CR-56 available from Fuji Photo Film Co., Ltd. can be mentioned as preferred color reversal film processing agents including the above feature.

With respect to the technologies, such as those regarding a bleaching solution, a magnetic recording layer, a polyester support and an antistatic agent, that are applicable to the silver halide photosensitive material of the present invention and with respect to the utilization of the present invention in Advanced Photo System, etc., reference can be made to US 2002/0042030 A1 (published on Apr. 11, 2002) and patents cited therein. Individual items and the locations where they are described will be listed below.

1. Bleaching solution: page 15 [0206];
2. Magnetic recording layer and magnetic particles: page 16 [0207] to [0213];
3. Polyester support: page 16 [0214] to page 17 [0218];
4. Antistatic agent: page 17 [0219] to [0221];
5. Sliding agent: page 17 [0222];
6. Matte agent: page 17 [0224];
7. Film cartridge: page 17 [0225] to page 18 [0227];
8. Use in Advanced Photo System: page 18 [0228], and [0238] to [0240];
9. Use in lens-equipped film: page 18 [0229]; and
10. Processing by minilab system: page 18 [0230] to [0237].

EXAMPLES

The present invention will be described in detail below with reference to the following Examples which however in no way limit the scope of the invention.

Example 1

Support

A support used in this example was formed by the following method.

(i) First Layer and Undercoat Layer

Glow discharge was performed on the two surfaces of a 90-μm thick polyethylenenaphthalate support at a processing ambient pressure of 26.6 Pa, an $H_2O$ partial pressure in the ambient gas of 75%, a discharge frequency of 30 kHz, an output of 2,500 W, and a processing intensity of 0.5 $kV \cdot A \cdot min/m^2$. One surface (back surface) of this support was coated with 5 $mL/m^2$ of a coating solution having the following composition as a first layer by using a bar coating method described in JP-B-58-4589, the disclosure of which is incorporated herein by reference.

Conductive fine-grain dispersion 50 parts by mass (a water dispersion having an $SnO_2/Sb_2O_5$ grain concentration of 10%, a secondary aggregate having a primary grain size of 0.005 μm and an average grain size of 0.05 μm).

| | |
|---|---|
| Gelatin | 0.5 parts by mass |
| Water | 49 parts by mass |
| Polyglycerolpolyglycidyl ether | 0.16 parts by mass |
| Poly(polymerization degree 20) oxyethylenesorbitanmonolaurate | 0.1 part by mass |

In addition, after the first layer was formed by coating, the support was wound on a stainless-steel core 20 cm in diameter and heated at 110° C. (Tg of PEN support: 119° C.) for 48 hr so as to be given thermal hysteresis, thereby performing annealing. After that, the side (emulsion surface side) of the support away from the first layer side was coated with 10 $mL/m^2$ of a coating solution having the following composition as an undercoat layer for emulsions, by using a bar coating method.

| | |
|---|---|
| Gelatin | 1.01 parts by mass |
| Salicylic acid | 0.30 parts by mass |
| Resorcin | 0.40 parts by mass |
| Poly(polymerization degree 10) oxyethylenenonylphenyl ether | 0.11 parts by mass |
| Water | 3.53 parts by mass |
| Methanol | 84.57 parts by mass |
| n-Propanol | 10.08 parts by mass |

Furthermore, second and third layers to be described later were formed in this order on the first layer by coating. Subsequently, the opposite side was coated with multiple layers of a color negative light-sensitive material having a composition to be described later, thereby making a transparent magnetic recording medium having silver halide emulsion layers.

(ii) Second Layer (Transparent Magnetic Recording Layer)

(1) Dispersion of Magnetic Substance 1,100 parts by mass of a Co-deposited $\gamma$-$Fe_2O_3$ magnetic substance (average long axis length: 0.25 μm, SBET: 39 $m^2/g$, Hc: $6.56 \times 10^4$ A/m, σs: 77.1 $Am^2/kg$, σr: 37.4 $Am^2/kg$), 220 parts by mass of water, and 165 parts by mass of a silane coupling agent [3-(poly(polymerization degree 10)oxyethynyl)oxypropyl trimethoxysilane] were added and well kneaded for 3 hr by an open kneader. This coarsely dispersed viscous solution was dried at 70° C. for 24 hr to remove water and heated at 110° C. for 1 hr to form surface-treated magnetic grains.

These grains were again kneaded for 4 hr by the following formulation by using an open kneader.

| | |
|---|---|
| Above-mentioned surface-treated magnetic grains | 855 g |
| Diacetylcellulose | 25.3 g |
| Methylethylketone | 136.3 g |
| Cyclohexanone | 136.3 g |

The resultant material was finely dispersed at 2,000 rpm for 4 hr by the following formulation by using a sand mill (¼ G sand mill). Glass beads 1 mm in diameter were used as media.

| | |
|---|---|
| Above-mentioned kneaded solution | 45 g |
| Diacetylcellulose | 23.7 g |
| Methylethylketone | 127.7 g |
| Cyclohexanone | 127.7 g |

Furthermore, magnetic substance-containing intermediate solution was formed by the following formulation.

(2) Formation of Magnetic Substance-Containing Intermediate Solution

| | |
|---|---|
| Above-mentioned magnetic substance finely dispersed solution | 674 g |
| Diacetylcellulose solution (solid content 4.34%, solvent: methylethylketone/cyclohexanone = 1/1) | 24,280 g |
| Cyclohexanone | 46 g |

These materials were mixed, and the mixture was stirred by a disperser to form a "magnetic substance-containing intermediate solution".

An α-alumina polishing material dispersion of the present invention was formed by the following formulation.

(a) Sumicorundum AA-1.5 (Average Primary Grain Size 1.5 μm, Specific Surface Area 1.3 $m^2/g$)

Formation of Grain Dispersion

| | |
|---|---|
| Sumikorandom AA-1.5 | 152 g |
| Silane coupling agent KBM 903 (manufactured by Shin-Etsu Silicone) | 0.48 g |
| Diacetylcellulose solution (solid content 4.5%, solvent: methylethylketone/cyclohexanone = 1/1) | 227.52 g |

The above formulation was finely dispersed at 800 rpm for 4 hr by using a ceramic-coated sand mill (¼ G sand mill). Zirconia beads 1 mm in diameter were used as media.

(b) Colloidal Silica Grain Dispersion (Fine Grains)

"MEK-ST" manufactured by Nissan Chemical Industries, Ltd. was used.

"MEK-ST" was a colloidal silica dispersion containing methylethylketone as a dispersion medium and having an average primary grain size of 0.015 μm. The solid content is 30%.

(3) Formation of Second Layer Coating Solution

| | |
|---|---|
| Above-mentioned magnetic substance-containing intermediate solution | 19,053 g |
| Diacetylcellulose solution (solid content 4.5%, solvent: methylethylketone/cyclohexanone = 1/1) | 264 g |
| Colloidal silicon dispersion "MEK-ST" [dispersion b] (solid content 30%) | 128 g |
| AA-1.5 dispersion [dispersion a] | 12 g |
| Millionate MR-400 (manufactured by Nippon Polyurethane K.K.) diluted solution (solid content 20%, diluent solvent: methylethylketone/cyclohexanone = 1/1) | 203 g |
| Methylethylketone | 170 g |
| Cyclohexanone | 170 g |

A coating solution formed by mixing and stirring the above materials was coated in an amount of 29.3 $mL/m^2$ by using a wire bar. The solution was dried at 110° C. The thickness of the dried magnetic layer was 1.0 μm.

(iii) Third Layer (Higher Fatty Acid Ester Slipping Agent-Containing Layer)

(1) Formation of Undiluted Dispersion

A solution A presented below was dissolved at 100° C. and added to a solution B. The resultant solution mixture was dispersed by a high-pressure homogenizer to form an undiluted dispersion of a slipping agent.

| | |
|---|---|
| Solution A | |
| Compound below $C_6H_{13}CH(OH)(CH_2)_{10}COOC_{50}H_{101}$ | 399 parts by mass |
| Compound below $n\text{-}C_{50}H_{101}O(CH_2CH_2O)_{16}H$ | 177 parts by mass |
| Cyclohexanone | 830 parts by mass |
| Solution B | |
| Cyclohexanone | 8,600 parts by mass |

(2) Formation of Spherical Inorganic Grain Dispersion

A spherical inorganic grain dispersion [c1] was formed by the following formulation.

| | |
|---|---|
| Isopropyl alcohol | 93.54 parts by mass |
| Silane coupling agent KBM903 (manufactured by Shin-Etsu Silicone) compound 1-1: $(CH_3O)_3Si—(CH_2)_3—NH_2$) | 5.53 parts by mass |
| W-5 | 2.93 parts by mass |
| SEAHOSTAR KEP50 (amorphous spherical silica, average grain size 0.5 μm, manufactured by NIPPON SHOKUBAI Co., Ltd.) | 88.00 parts by mass |

The above formulation was stirred for 10 min, and the following was further added.

| | |
|---|---|
| Diacetone alcohol | 252.93 parts by mass |

Under ice cooling and stirring, the above solution was dispersed for 3 hr by using the "SONIFIER450 (manufactured by BRANSON K.K.)" ultrasonic homogenizer, thereby completing the spherical inorganic grain dispersion c1.

(3) Formation of Spherical Organic Polymer Grain Dispersion

A spherical organic polymer grain dispersion [c2] was formed by the following formulation.

| | |
|---|---|
| XC99-A8808 (manufactured by TOSHIBA SILICONE K.K., spherical crosslinked polysiloxane grain, average grain size 0.9 μm) | 60 parts by mass |
| Methylethylketone | 120 parts by mass |
| Cyclohexanone | 120 parts by mass |
| (solid content 20%, solvent: methylethylketone/cyclohexanone = 1/1) | |

Under ice cooling and stirring, the above solution was dispersed for 2 hr by using the "SONIFIER450 (manufactured by BRANSON K.K.)" ultrasonic homogenizer, thereby completing the spherical organic polymer grain dispersion c2.

(4) Formation of Third Layer Coating Solution

The following components were added to 542 g of the aforementioned slipping agent undiluted dispersion to form a third layer coating solution.

| | |
|---|---|
| Diacetone alcohol | 5,950 g |
| Cyclohexanone | 176 g |
| Ethyl acetate | 1,700 g |
| Above-mentioned SEEHOSTA KEP50 dispersion [c1] | 53.1 g |
| Above-mentioned spherical organic polymer grain dispersion [c2] | 300 g |
| FC431 (manufactured by 3M K.K., solid content 50%, solvent: ethyl acetate) | 2.65 g |
| BYK310 (manufactured by BYK Chemi Japan K.K., solid content 25%) | 5.3 g |

The above third layer coating solution was coated in an amount of 10.35 mL/m$^2$ on the second layer, dried at 110° C., and further dried at 97° C. for 3 min.

(iv) Coating of Light-Sensitive Layers

The opposite side of the back layers obtained as above was coated with a plurality of layers to make a color negative film.

(Compositions of Light-Sensitive Layers)

The number corresponding to each component indicates the coating amount in units of g/m$^2$. The coating amount of a silver halide is indicated by the amount of silver.

(Sample 101)

| | | |
|---|---|---|
| 1st layer (1st antihalation layer) | | |
| Black colloidal silver | silver | 0.075 |
| Silver iodobromide emulsion (average equivalent-sphere diameter 0.07 μm, silver iodide content 1 mol %) | | |
| silver | | 0.011 |
| Gelatin | | 0.740 |
| ExM-1 | | 0.068 |
| ExC-1 | | 0.002 |
| ExC-3 | | 0.002 |
| Cpd-2 | | 0.001 |
| F-8 | | 0.001 |

-continued

| | | |
|---|---|---|
| HBS-1 | | 0.099 |
| HBS-2 | | 0.013 |
| 2nd layer (2nd antihalation layer) | | |
| Black colloidal silver | silver | 0.094 |
| Gelatin | | 0.667 |
| ExF-1 | | 0.002 |
| F-8 | | 0.001 |
| Solid disperse dye ExF-7 | | 0.100 |
| HBS-1 | | 0.066 |
| 3rd layer (Interlayer) | | |
| ExC-2 | | 0.050 |
| Cpd-1 | | 0.089 |
| Polyethylaclyrate latex | | 0.200 |
| HBS-1 | | 0.054 |
| Gelatin | | 0.458 |
| 4th layer (Low-speed red-sensitive emulsion layer) | | |
| Em-C | silver | 0.310 |
| Em-D | silver | 0.424 |
| ExC-1 | | 0.354 |
| ExC-2 | | 0.014 |
| ExC-3 | | 0.093 |
| ExC-4 | | 0.193 |
| ExC-5 | | 0.034 |
| ExC-6 | | 0.015 |
| ExC-8 | | 0.053 |
| ExC-9 | | 0.020 |
| Cpd-2 | | 0.025 |
| Cpd-4 | | 0.025 |
| Cpd-7 | | 0.015 |
| UV-2 | | 0.022 |
| UV-3 | | 0.042 |
| UV-4 | | 0.009 |
| UV-5 | | 0.075 |
| HBS-1 | | 0.274 |
| HBS-5 | | 0.038 |
| Gelatin | | 2.757 |
| 5th layer (Medium-speed red-sensitive emulsion layer) | | |
| Em-B | silver | 1.162 |
| ExM-5 | | 0.011 |
| ExC-1 | | 0.304 |
| ExC-2 | | 0.057 |
| ExC-3 | | 0.020 |
| ExC-4 | | 0.135 |
| ExC-5 | | 0.012 |
| ExC-6 | | 0.039 |
| ExC-8 | | 0.016 |
| ExC-9 | | 0.077 |
| Cpd-2 | | 0.056 |
| Cpd-4 | | 0.035 |
| Cpd-7 | | 0.020 |
| HBS-1 | | 0.190 |
| Gelatin | | 1.346 |
| 6th layer (High-speed red-sensitive emulsion layer) | | |
| Em-A | silver | 0.922 |
| ExM-5 | | 0.156 |
| ExC-1 | | 0.066 |
| ExC-3 | | 0.015 |
| ExC-6 | | 0.027 |
| ExC-8 | | 0.114 |
| ExC-9 | | 0.089 |
| ExC-10 | | 0.107 |
| ExY-3 | | 0.010 |
| Cpd-2 | | 0.070 |
| Cpd-4 | | 0.079 |
| Cpd-7 | | 0.030 |
| HBS-1 | | 0.314 |
| HBS-2 | | 0.120 |
| Gelatin | | 1.206 |
| 7th layer (Interlayer) | | |
| Cpd-1 | | 0.078 |
| Cpd-6 | | 0.369 |
| Solid disperse dye ExF-4 | | 0.030 |
| HBS-1 | | 0.048 |

-continued

| | | |
|---|---|---|
| Polyethylacrylate latex | | 0.088 |
| Gelatin | | 0.739 |
| 8th layer (layer for donating interlayer effect to red-sensitive layer) | | |
| Em-E | silver | 0.418 |
| Cpd-4 | | 0.034 |
| ExM-2 | | 0.121 |
| ExM-3 | | 0.002 |
| ExM-4 | | 0.035 |
| ExY-1 | | 0.018 |
| ExY-4 | | 0.038 |
| ExC-7 | | 0.036 |
| HBS-1 | | 0.343 |
| HBS-3 | | 0.006 |
| HBS-5 | | 0.030 |
| Gelatin | | 0.884 |
| 9th layer (Low-speed green-sensitive emulsion layer) | | |
| Em-H | silver | 0.266 |
| Em-I | silver | 0.248 |
| Em-J | silver | 0.315 |
| ExM-2 | | 0.344 |
| ExM-3 | | 0.055 |
| ExY-1 | | 0.018 |
| ExY-3 | | 0.014 |
| ExC-7 | | 0.004 |
| HBS-1 | | 0.505 |
| HBS-3 | | 0.012 |
| HBS-4 | | 0.095 |
| HBS-5 | | 0.055 |
| Cpd-5 | | 0.010 |
| Cpd-7 | | 0.020 |
| Gelatin | | 1.382 |
| 10th layer (Medium-speed green-sensitive emulsion layer) | | |
| Em-G | silver | 0.449 |
| ExM-2 | | 0.046 |
| ExM-3 | | 0.033 |
| ExM-5 | | 0.019 |
| ExY-3 | | 0.006 |
| ExC-6 | | 0.010 |
| ExC-7 | | 0.011 |
| ExC-8 | | 0.010 |
| ExC-9 | | 0.009 |
| HBS-1 | | 0.046 |
| HBS-3 | | 0.002 |
| HBS-4 | | 0.035 |
| HBS-5 | | 0.020 |
| Cpd-5 | | 0.004 |
| Cpd-7 | | 0.010 |
| Gelatin | | 0.446 |
| 11th layer (High-speed green-sensitive emulsion layer) | | |
| Em-F | silver | 0.487 |
| Em-H | silver | 0.291 |
| ExC-6 | | 0.007 |
| ExC-8 | | 0.012 |
| ExC-9 | | 0.014 |
| ExM-1 | | 0.019 |
| ExM-2 | | 0.056 |
| ExM-3 | | 0.013 |
| ExM-4 | | 0.034 |
| ExM-5 | | 0.039 |
| ExM-6 | | 0.021 |
| ExY-3 | | 0.005 |
| Cpd-3 | | 0.005 |
| Cpd-4 | | 0.007 |
| Cpd-5 | | 0.010 |
| Cpd-7 | | 0.020 |
| HBS-1 | | 0.248 |
| HBS-3 | | 0.003 |
| HBS-4 | | 0.094 |
| HBS-5 | | 0.037 |
| Polyethylacrylate latex | | 0.099 |
| Gelatin | | 0.950 |
| 12th layer (Yellow filter layer) | | |
| Cpd-1 | | 0.090 |
| Solid disperse dye ExF-2 | | 0.070 |

-continued

| | | |
|---|---|---|
| Solid disperse dye ExF-5 | | 0.010 |
| Oil-soluble dye ExF-6 | | 0.010 |
| HBS-1 | | 0.055 |
| Gelatin | | 0.589 |
| 13th layer (Low-speed blue-sensitive emulsion layer) | | |
| Em-M | silver | 0.322 |
| Em-N | silver | 0.179 |
| Em-0 | silver | 0.092 |
| ExC-1 | | 0.006 |
| ExC-3 | | 0.033 |
| ExC-7 | | 0.014 |
| ExY-1 | | 0.088 |
| ExY-2 | | 0.404 |
| ExY-4 | | 0.056 |
| ExY-5 | | 0.404 |
| Cpd-2 | | 0.102 |
| Cpd-3 | | 0.004 |
| HBS-1 | | 0.337 |
| HBS-5 | | 0.070 |
| Gelatin | | 1.876 |
| 14th layer (High-speed blue-sensitive emulsion layer) | | |
| Em-L | silver | 0.426 |
| Em-K | silver | 0.416 |
| ExM-5 | | 0.012 |
| ExC-1 | | 0.010 |
| ExY-1 | | 0.041 |
| ExY-2 | | 0.119 |
| ExY-3 | | 0.008 |
| ExY-4 | | 0.070 |
| ExY-5 | | 0.120 |
| Cpd-2 | | 0.074 |
| Cpd-3 | | 0.001 |
| Cpd-7 | | 0.030 |
| HBS-1 | | 0.122 |
| Gelatin | | 0.905 |
| 15th layer (1st protective layer) | | |
| Silver iodobromide emulsion (average equivalent-sphere diameter 0.07 μm, silver iodide content 1 mol %) | silver | 0.283 |
| UV-1 | | 0.167 |
| UV-2 | | 0.066 |
| UV-3 | | 0.099 |
| UV-4 | | 0.013 |
| UV-5 | | 0.160 |
| F-11 | | 0.008 |
| S-1 | | 0.077 |
| HBS-1 | | 0.175 |
| HBS-4 | | 0.017 |
| Gelatin | | 1.297 |
| 16th layer (2nd protective layer) | | |
| H-1 | | 0.400 |
| B-1 (diameter 1.7 μm) | | 0.050 |
| B-2 (diameter 1.7 μm) | | 0.150 |
| B-3 | | 0.029 |
| S-1 | | 0.200 |
| Gelatin | | 0.748 |

In addition to the above components, to improve the storage stability, processability, resistance to pressure, antiseptic and mildewproofing properties, antistatic properties, and coating properties, the individual layers contained W-1 to W-6, B-4 to B-6, F-1 to F-19, lead salt, platinum salt, iridium salt, and rhodium salt.

Preparation of Dispersions of Organic Solid Disperse Dyes

ExF-2 in the 12th layer was dispersed by the following method.

| | |
|---|---|
| Wet cake (containing 17.6 mass % of water) of ExF-2 | 2.800 kg |
| Sodium octylphenyldiethoxymethane sulfonate (31 mass % aqueous solution) | 0.376 kg |
| F-15 (7% aqueous solution) | 0.011 kg |
| Water | 4.020 kg |
| Total (pH was adjusted to 7.2 by NaOH) | 7.210 kg |

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill until the absorbance ratio of the dispersion was 0.29, thereby obtaining a solid disperse dye ExF-2. The average grain size of the fine dye grains was 0.29 μm.

Following the same procedure as above, solid disperse dyes ExF-4 and ExF-7 were obtained. The average grain sizes of the fine dye grains were 0.28 and 0.49 μm, respectively. ExF-5 was dispersed by a microprecipitation dispersion method described in Example 1 of EP549,489A, the disclosure of which is incorporated herein by reference. The average grain size was found to be 0.06 μm.

TABLE 1

Emulsion structure of sample 101

| Emulsion name | Layer used | Grain shape | ESD* (μm) | ECD(μm)**/ VC(%)*** |
|---|---|---|---|---|
| Em-A | High-speed red-sensitive layer | (111)main plane tabular grain | 0.95 | 1.90/32 |
| Em-B | Medium-speed red-sensitive layer | (111)main plane tabular grain | 0.69 | 1.30/35 |
| Em-C | Low-speed red-sensitive layer | (111)main plane tabular grain | 0.48 | 0.89/17 |
| Em-D | Low-speed red-sensitive layer | (111)main plane tabular grain | 0.31 | 0.40/20 |
| Em-E | Layer for donating interlayer effect to red-sensitive layer | (111)main plane tabular grain | 0.78 | 1.38/24 |
| Em-F | High-speed green-sensitive layer | (111)main plane tabular grain | 1.00 | 2.00/33 |
| Em-G | Medium-speed green-sensitive layer | (111)main plane tabular grain | 0.74 | 1.64/34 |
| Em-H | High and low-speed green-sensitive layers | (111)main plane tabular grain | 0.74 | 1.39/25 |
| Em-I | Low-speed green-sensitive layer | (111)main plane tabular grain | 0.55 | 0.79/30 |
| Em-j | Low-speed green-sensitive layer | (111)main plane tabular grain | 0.44 | 0.53/30 |
| Em-K | High-speed blue-sensitive layer | (111)main plane tabular grain | 1.60 | 3.00/25 |
| Em-L | High-speed blue-sensitive layer | (111)main plane tabular grain | 1.30 | 2.20/24 |
| Em-M | Low-speed blue-sensitive layer | (111)main plane tabular grain | 0.81 | 1.10/30 |
| Em-N | Low-speed blue-sensitive layer | (111)main plane tabular grain | 0.40 | 0.55/32 |
| Em-O | Low-speed blue-sensitive layer | (100)main plane cubic grain | 0.21 | 0.21/20 |

*ESD: average equivalent-sphere diameter
**ECD: average equivalent-circular diameter
***VC: variation coefficient

TABLE 2

Emulsion structure of sample 101

| Emulsion name | Av. thickness (μm)/VC* (%) | Av. aspect ratio | Ratio of tabular grains in number (%) | Av. silver iodide content (mol %)/VC* of inter-grain (%) | Surface silver iodide content (mol %) | (100) face ratio in side planes (%) |
|---|---|---|---|---|---|---|
| Em-A | 0.19/14 | 10 | 97 | 4.7/10 | 3.90 | 20 |
| Em-B | 0.10/15 | 13 | 98 | 6.7/11 | 5.00 | 30 |
| Em-C | 0.09/12 | 10 | 99 | 1.5/10 | 3.70 | 25 |
| Em-D | 0.09/9.3 | 4.5 | 98 | 1.1/11 | 5.00 | 25 |
| Em-E | 0.15/13 | 9.2 | 97 | 5.2/10 | 5.90 | 35 |
| Em-F | 0.18/14 | 11 | 99 | 4.7/10 | 3.90 | 20 |
| Em-G | 0.10/15 | 16 | 96 | 7.3/13 | 5.60 | 30 |
| Em-H | 0.14/11 | 9.9 | 98 | 5.5/14 | 5.97 | 30 |
| Em-I | 0.14/13 | 5.5 | 97 | 5.4/12 | 7.39 | 20 |
| Em-J | 0.17/18 | 3.2 | 97 | 2.7/14 | 5.68 | 35 |
| Em-K | 0.31/21 | 10 | 99 | 5.6/7.0 | 3.88 | 40 |
| Em-L | 0.34/22 | 7 | 98 | 5.7/8.0 | 5.50 | 20 |
| Em-M | 0.23/16 | 4.7 | 97 | 6.8/9.0 | 1.90 | 30 |
| Em-N | 0.13/16 | 4.6 | 96 | 3.7/10 | 5.50 | 30 |
| Em-O | 0.21/20 | 1 | — | 1.9/9.0 | 4.50 | — |

*VC: variation coefficient

TABLE 3

Emulsion structure of sample 101

| Emulsion name | Av. silver chloride content (mol %)/VC* of inter-grain (%) | Surface silver chloride content (mol %) | Twin plane spacing (μm)/VC* (%) | Av. thickness of core portion (μm) | Annual ring structure | Number of dislocation lines |
|---|---|---|---|---|---|---|
| Em-A | 0 | 0 | 0.011/30 | 0.13 | Presence | 10≦ |
| Em-B | 0 | 0 | 0.010/30 | 0.07 | Absence | 10≦ |
| Em-C | 0 | 0 | 0.010/31 | 0.06 | Absence | 10≦ |
| Em-D | 0 | 0 | 0.009/29 | 0.06 | Absence | 10≦ |
| Em-E | 0 | 0 | 0.012/30 | 0.1 | Absence | 10≦ |
| Em-F | 0 | 0 | 0.012/30 | 0.12 | Presence | 10≦ |
| Em-G | 0 | 0 | 0.010/30 | 0.07 | Absence | 10≦ |
| Em-H | 0 | 0 | 0.011/30 | 0.09 | Absence | 10≦ |
| Em-I | 0 | 0 | 0.016/32 | 0.09 | Absence | 10≦ |
| Em-J | 0 | 0 | 0.016/32 | 0.11 | Absence | 10≦ |
| Em-K | 0 | 0 | 0.010/29 | 0.21 | Absence | 10≦ |
| Em-L | 0 | 0 | 0.017/33 | 0.23 | Absence | 10≦ |
| Em-M | 0 | 0 | 0.019/30 | 0.15 | Absence | 10≦ |
| Em-N | 0 | 0 | 0.020/31 | 0.09 | Absence | 10≦ |
| Em-O | 0 | 0 | — | — | Absence | — |

*VC: variation coefficient

TABLE 4

Emulsion structure of sample 101

| Emulsion name | Characteristics of grains occupying 50% or more in number of all the grains | Silver amount ratio of grain structure (%) and halogen composition (listed in order from center of grain) |
|---|---|---|
| Em-A | (111)main plane tabular grain | (11%)AgBr/(35%)$AgBr_{97}I_3$/(18%)AgBr/(9%)$AgBr_{62}I_{38}$/(27%)AgBr |
| Em-B | (111)main plane tabular grain | (7%)AgBr/(31%)$AgBr_{97}I_3$/(16%)AgBr/(12%)$AgBr_{62}I_{38}$/(34%)AgBr |
| Em-C | (111)main plane tabular grain | (1%)AgBr/(77%)$AgBr_{99}I_1$/(9%)$AgBr_{95}I_5$/(13%)AgBr |
| Em-D | (111)main plane tabular grain | (57%)AgBr/(14%)$AgBr_{96}I_4$/(29%)AgBr |
| Em-E | (111)main plane tabular grain | (13%)AgBr/(36%)$AgBr_{97}I_3$/(7%)AgBr/(11%)$AgBr_{62}I_{38}$/(33%)AgBr |
| Em-F | (111)main plane tabular grain | (11%)AgBr/(35%)$AgBr_{97}I_3$/(18%)AgBr/(4%)AgI/(32%)AgBr |
| Em-G | (111)main plane tabular grain | (7%)AgBr/(31%)$AgBr_{97}I_3$/(15%)AgBr/(14%)$AgBr_{62}I_{38}$/(33%)AgBr |
| Em-H | (111)main plane tabular grain | (14%)AgBr/(36%)$AgBr_{97}I_3$/(7%)AgBr/(11%)$AgBr_{62}I_{38}$/(32%)AgBr |
| Em-I | (111)main plane tabular grain | (15%)AgBr/(44%)$AgBr_{97}I_3$/(11%)AgBr/(5%)AgI/(25%)AgBr |
| Em-J | (111)main plane tabular grain | (60%)AgBr/(2%)AgI/(38%)AgBr |
| Em-K | (111)main plane tabular grain | (68%)$AgBr_{93}I_7$/(21%)AgBr/(1%)AgI/(10%)AgBr |
| Em-L | (111)main plane tabular grain | (8%)AgBr/(10%)$AgBr_{95}I_5$/(52%)$AgBr_{93}I_7$/(11%)AgBr/(2%)AgI/(17%)AgBr |
| Em-M | (111)main plane tabular grain | (12%)AgBr/(43%)$AgBr_{90}I_{10}$/(14%)AgBr/(2%)AgI/(29%)AgBr |
| Em-N | (111)main plane tabular grain | (58%)AgBr/(4%)AgI/(38%)AgBr |
| Em-O | (100)main plane cubic grain | (6%)AgBr/(94%)$AgBr_{96}I_4$ |

TABLE 5

Emulsion structure of sample 101

| Emulsion name | Sensitizing dye | Dopant |
|---|---|---|
| Em-A | 1, 3, 4 | $K_2IrCl_6$ |
| Em-B | 2, 3, 4 | $K_2IrCl_6$, $K_2IrCl_5(H_2O)$, $K_4Ru(CN)_6$ |
| Em-C | 1, 3, 4 | $K_2IrCl_6$, $K_4Fe(CN)_6$ |
| Em-D | 1, 3, 4 | $K_2IrCl_6$, $K_4Fe(CN)_6$ |
| Em-E | 5, 10 | $K_4Fe(CN)_6$ |
| Em-F | 5, 6, 9 | — |
| Em-G | 5, 6, 9 | $K_2IrCl_6$, $K_4Fe(CN)_6$ |
| Em-H | 6, 7, 8 | $K_2IrCl_6$, $K_4Fe(CN)_6$ |
| Em-I | 6, 8, 9 | $K_2IrCl_6$ |
| Em-J | 5, 6, 7 | $K_2IrCl_6$, $K_4Fe(CN)_6$ |
| Em-K | 14 | — |
| Em-L | 12 | — |
| Em-M | 14 | — |
| Em-N | 12, 13 | — |
| Em-O | 11, 13 | $K_2IrCl_6$ |

With respect to the emulsions Em-A to Em-C, the optimum gold sensitization, sulfur sensitization and selenium sensitization have been effected by addition of the optimum amount of spectral sensitizing dyes 1 to 4.

With respect to the emulsions Em-E to Em-G, the optimum gold sensitization, sulfur sensitization and selenium sensitization have been effected by addition of the optimum amount of spectral sensitizing dyes 5, 6, 9 and 10.

With respect to the emulsion Em-J, the optimum gold sensitization, sulfur sensitization and selenium sensitization have been effected by addition of the optimum amount of spectral sensitizing dyes 5 to 7.

With respect to the emulsion Em-L, the optimum gold sensitization, sulfur sensitization and selenium sensitization have been effected by addition of the optimum amount of a spectral sensitizing dye 12.

With respect to the emulsion Em-O, the optimum gold sensitization and sulfur sensitization have been effected by addition of the optimum amount of spectral sensitizing dyes 11 and 13.

With respect to the emulsions Em-D, Em-H, Em-I, Em-K, Em-M and Em-N, the optimum gold sensitization, sulfur sensitization and selenium sensitization have been effected by addition of the optimum amount of spectral sensitizing dyes listed in Table 6.

TABLE 6

| Emulsion name | Sensitizing dye | Addition amount (mol/mol silver) |
|---|---|---|
| Em-D | Sensitizing dye 1 | $5.44 \times 10^{-4}$ |
| | Sensitizing dye 3 | $2.35 \times 10^{-4}$ |
| | Sensitizing dye 4 | $7.26 \times 10^{-4}$ |
| Em-H | Sensitizing dye 6 | $6.52 \times 10^{-4}$ |
| | Sensitizing dye 7 | $1.35 \times 10^{-4}$ |
| | Sensitizing dye 8 | $2.48 \times 10^{-4}$ |
| Em-I | Sensitizing dye 6 | $6.09 \times 10^{-4}$ |
| | Sensitizing dye 8 | $1.26 \times 10^{-4}$ |
| | Sensitizing dye 9 | $2.32 \times 10^{-4}$ |
| Em-K | Sensitizing dye 14 | $8.51 \times 10^{-4}$ |
| Em-M | Sensitizing dye 14 | $7.29 \times 10^{-4}$ |
| Em-N | Sensitizing dye 12 | $6.56 \times 10^{-4}$ |
| | Sensitizing dye 13 | $3.28 \times 10^{-4}$ |

The sensitizing dyes described in Tables 5 and 6 will be shown below.

Sensitizing dye 1

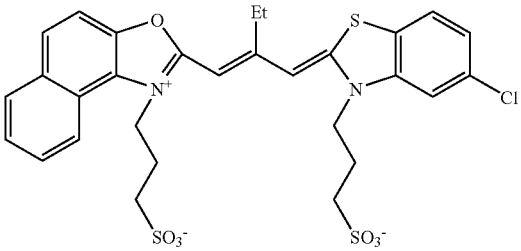

Sensitizing dye 2

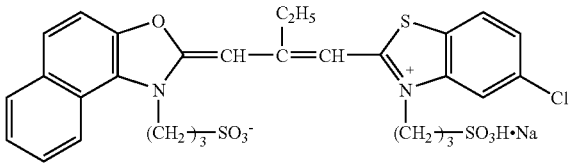

Sensitizing dye 3

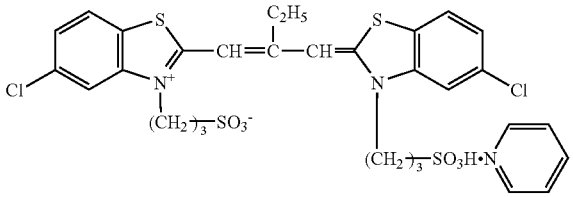

Sensitizing dye 4

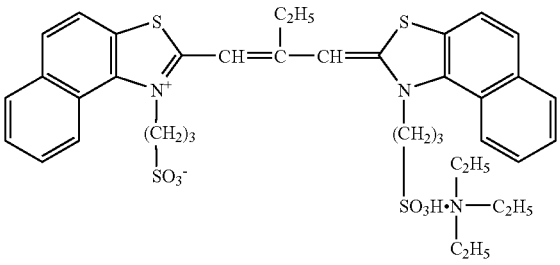

-continued

Sensitizing dye 5

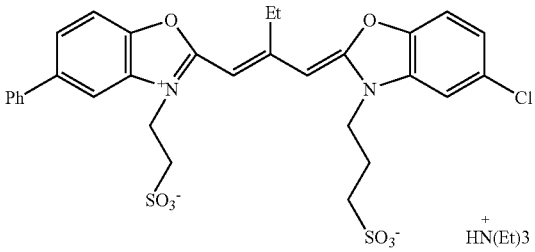

Sensitizing dye 6

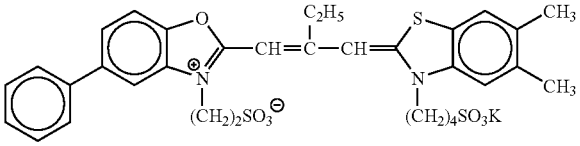

Sensitizing dye 7

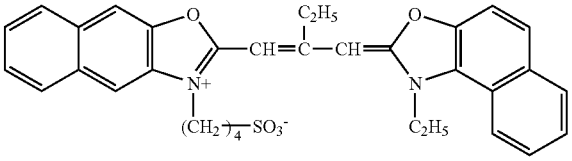

Sensitizing dye 8

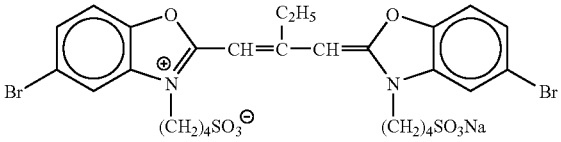

Sensitizing dye 9

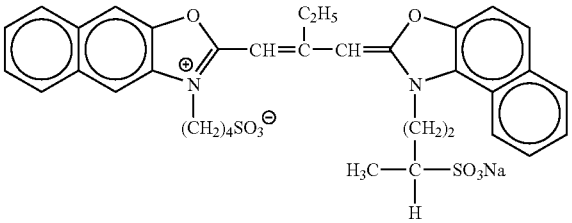

Sensitizing dye 10

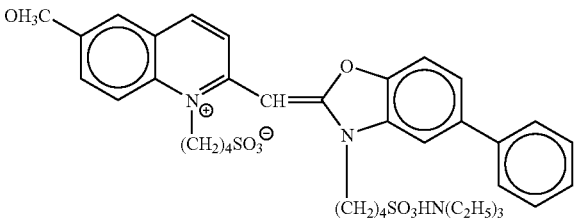

Sensitizing dye 11

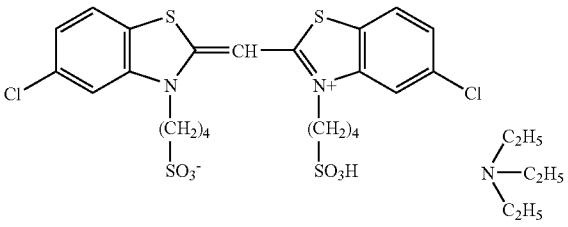

-continued

Sensitizing dye 12

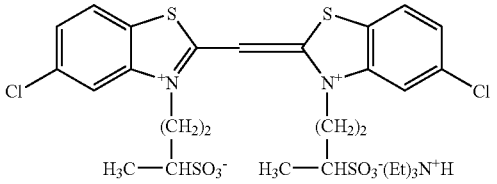

Sensitizing dye 13

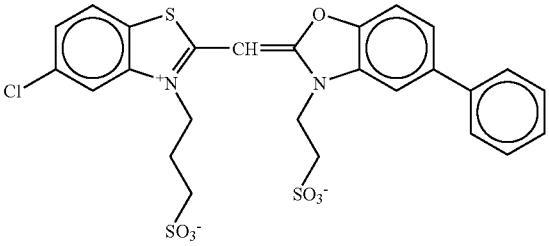

-continued

Sensitizing dye 14

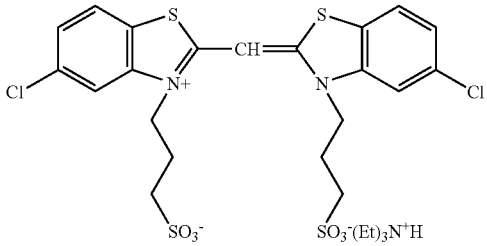

In the preparation of tabular grains, low-molecular-weight gelatins have been used in accordance with Examples of JP-A-1-158426.

Emulsions Em-A to Em-J contain the optimum amounts of Ir and Fe.

With respect to emulsions Em-L to Em-O, reduction sensitization thereof has been carried out at the time of grain formation.

With respect to emulsions Em-A to Em-C and emulsion Em-J, dislocation has been introduced with the use of iodide ion release agent in accordance with Examples of JP-A-6-11782.

With respect to emulsion Em-E, dislocation has been introduced with the use of silver iodide fine grains having been prepared just before addition in a separate chamber equipped with magnetic coupling induction type agitator as described in JP-A-10-43570.

The compounds used in the individual layers will be shown below.

ExF-1

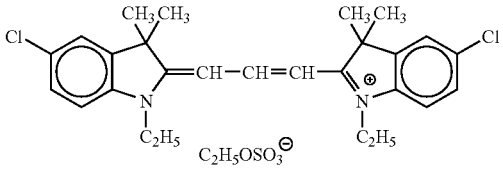

ExF-2

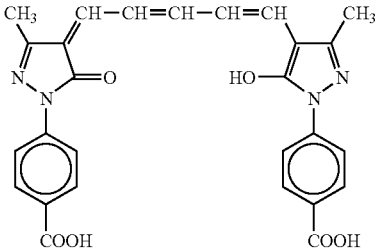

ExF-4

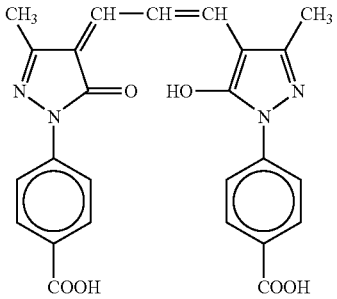

ExF-5

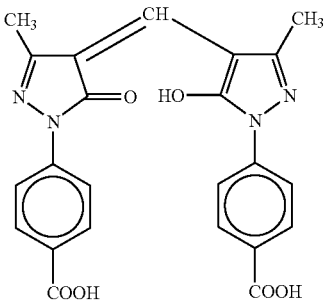

ExF-6

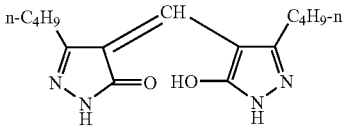

ExF-7

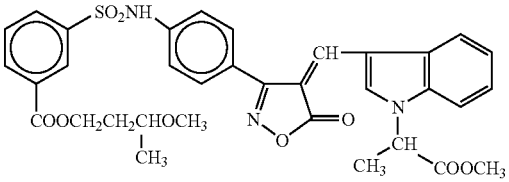

-continued
ExC-1
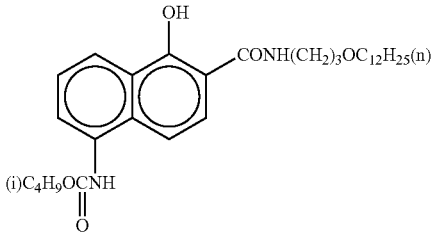
ExC-2
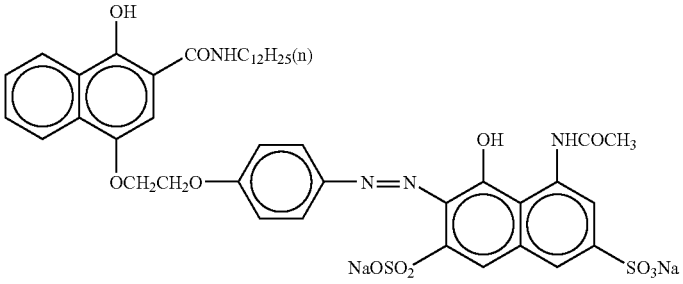
ExC-3
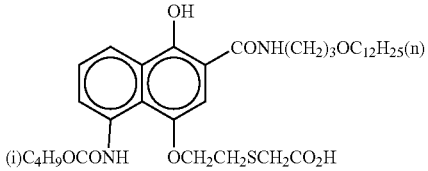
ExC-4
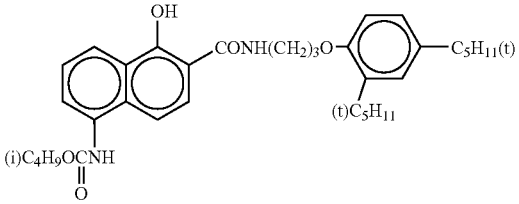
ExC-5
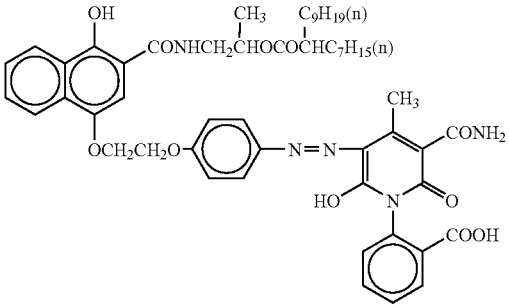
ExC-6
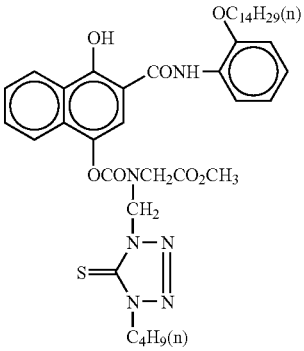
EXC-7
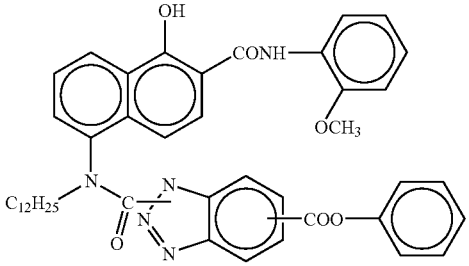

-continued
ExC-8
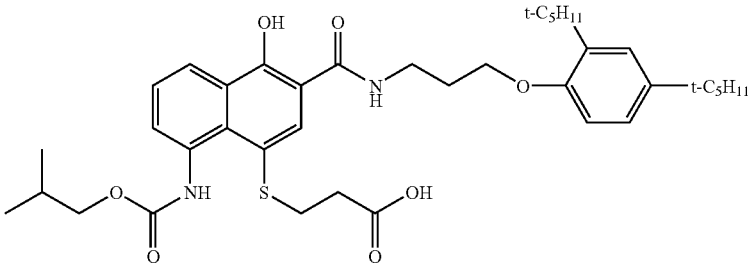
ExC-9
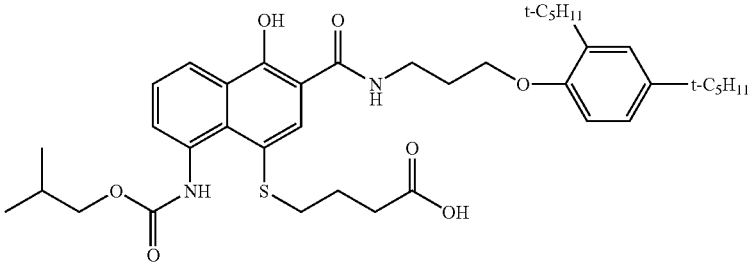
ExC-10
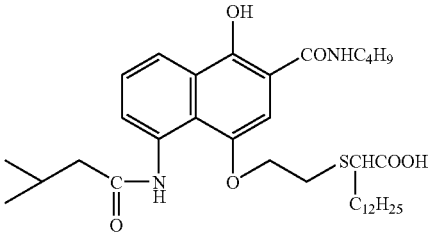
ExM-1
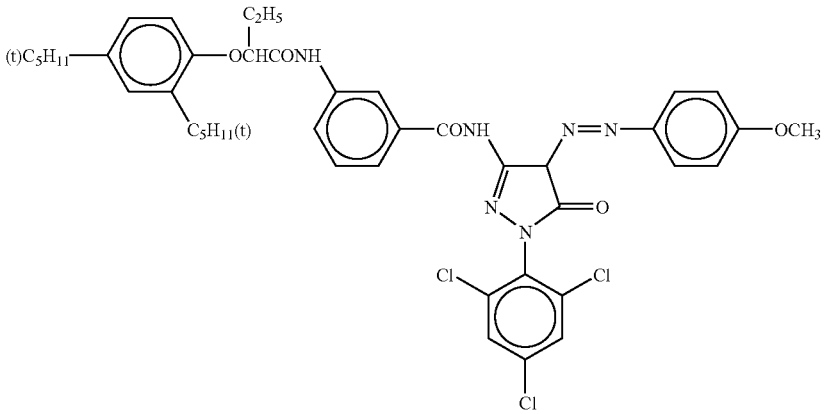
ExM-2
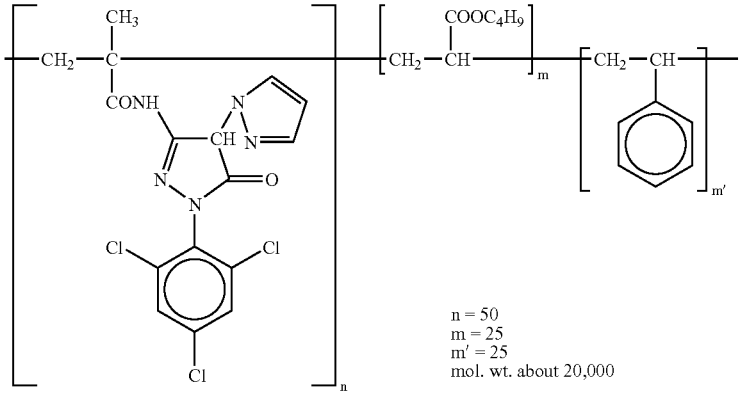

-continued
ExM-3
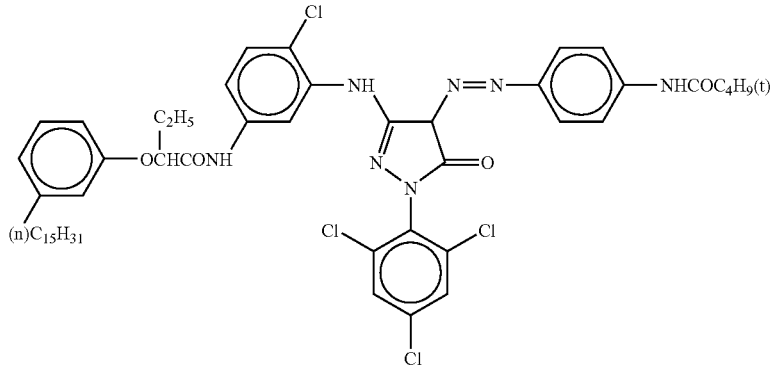
ExM-4
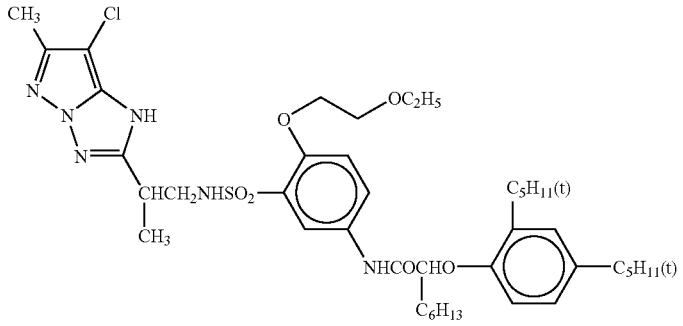
ExM-5
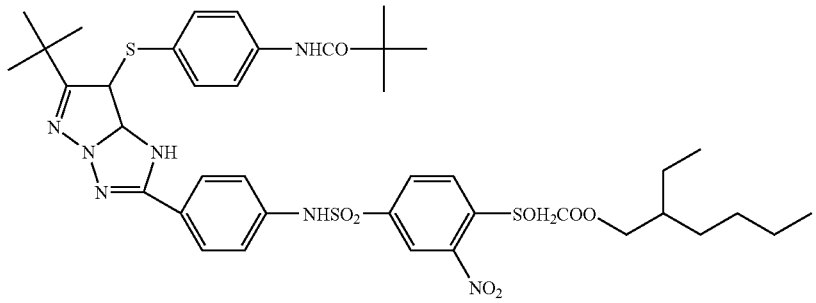
ExM-6
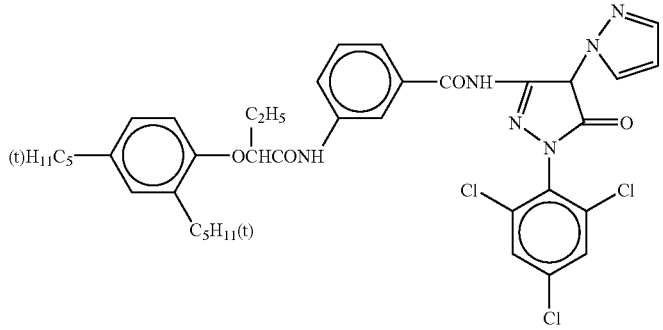

-continued
ExY-1
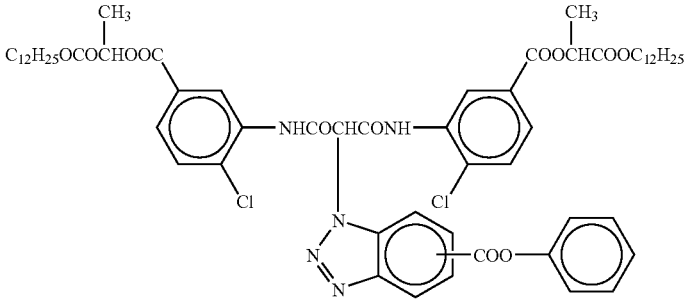
ExY-2
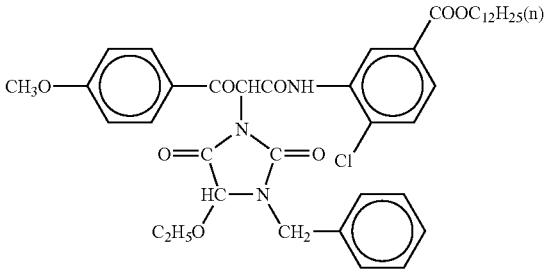
ExY-3
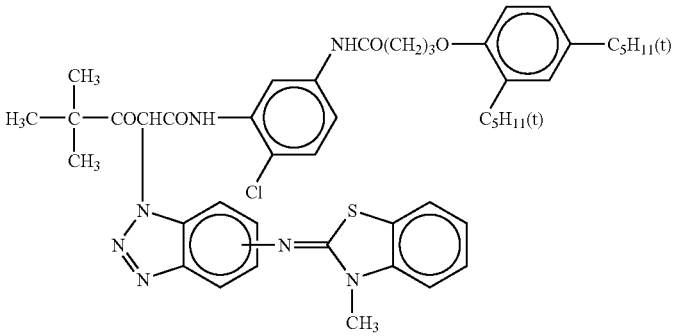
ExY-4
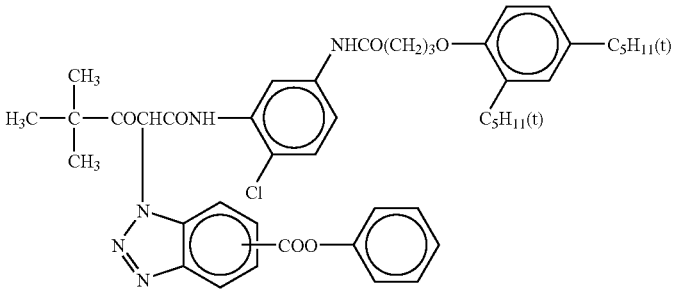
ExY-5
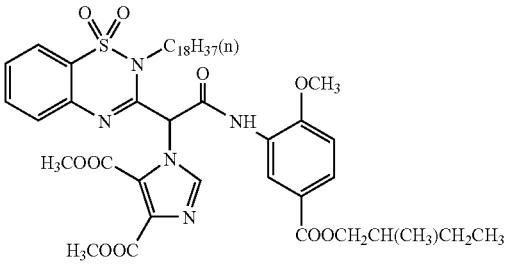
Cpd-1
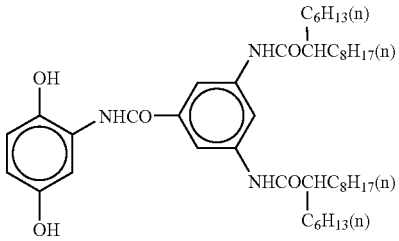

-continued
Cpd-2
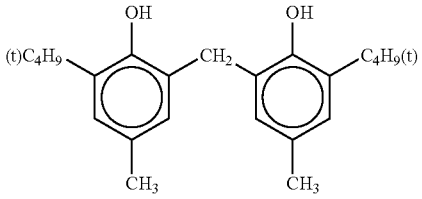
Cpd-3
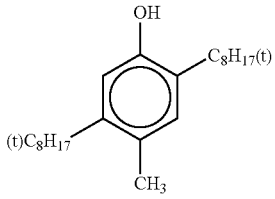
Cpd-4
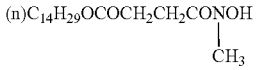
Cpd-5
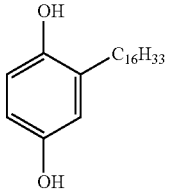
Cpd-6
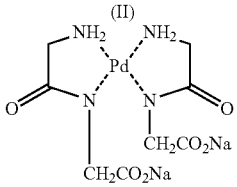
Cpd-7
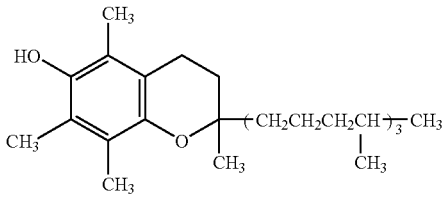
UV-1
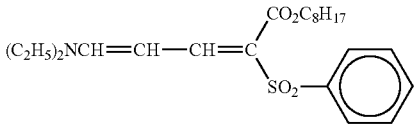
UV-2
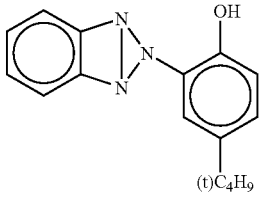
UV-3
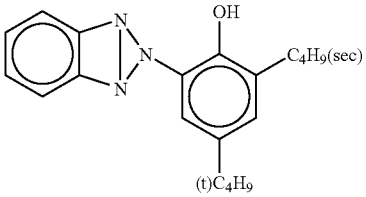
UV-4
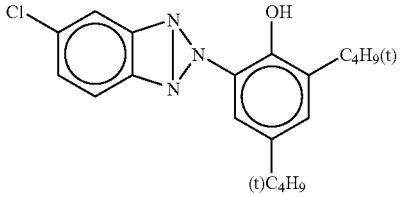
UV-5
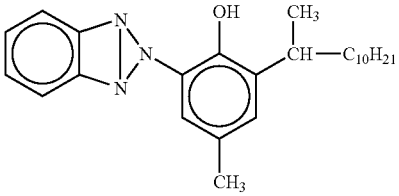
B-1
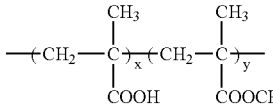
x/y = 10/90 (mass ratio)
Weight-average molecular weight: about 35,000
B-2
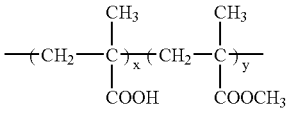
x/y = 40/60 (mass ratio)
Weight-average molecular weight: about 20,000
B-3
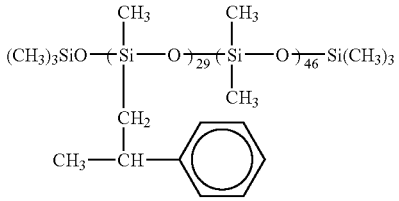
(mole ratio)
Weight-average molecular weight: about 8,000

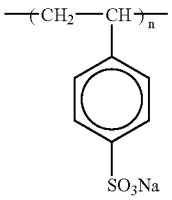
Weight-average molecular weight: about 750,000
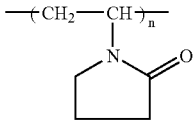
Weight-average molecular weight: about 10,000
Di-n-butyl phthalate
Tri(2-ethylhexyl)phosphate
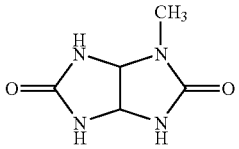
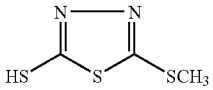
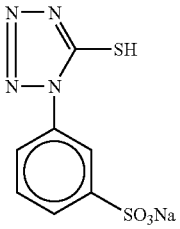
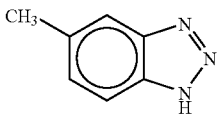
-continued
B-4
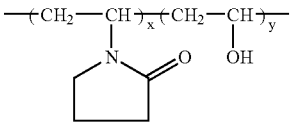
x/y = 70/30 (mass ratio)
Weight-average molecular weight: about 17,000
B-5
B-6
Tricresyl phosphate
HBS-1
HBS-2
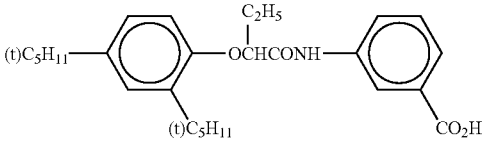
HBS-3
HBS-4
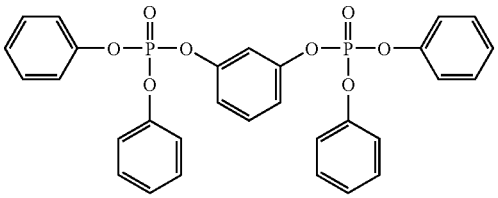
HBS-5
S-1
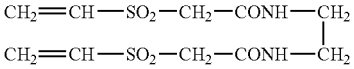
H-1
F-1
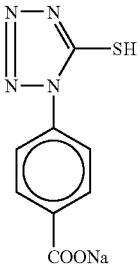
F-2
F-3
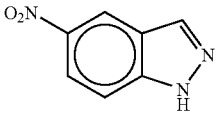
F-4
F-5
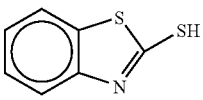
F-6

-continued
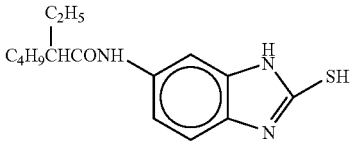
F-7
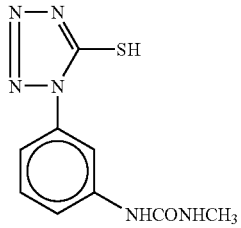
F-8
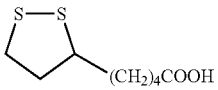
F-9
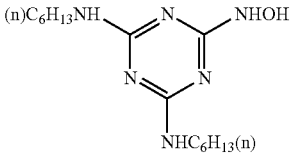
F-10
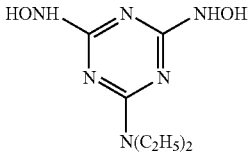
F-11
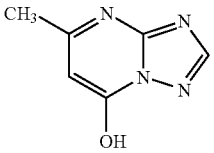
F-12
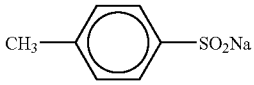
F-13
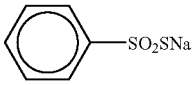
F-14
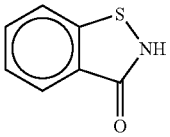
F-15
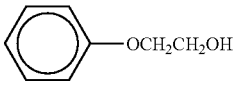
F-16
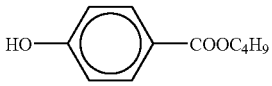
F-17
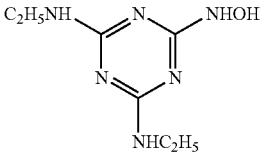
F-18
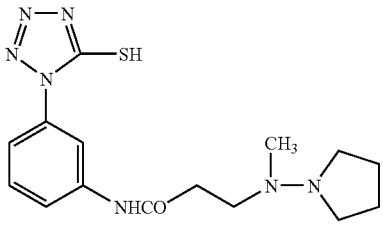
F-19
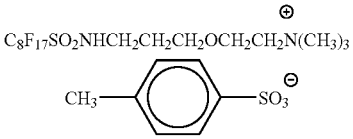
W-1
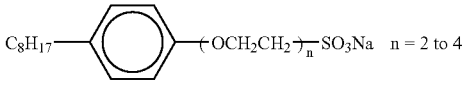
W-2
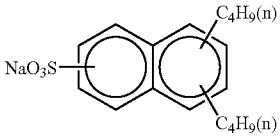
W-3
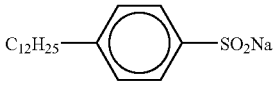
W-4
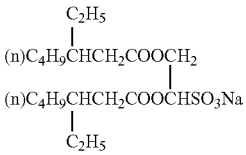
W-5

-continued

W-6

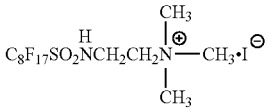

The silver halide photosensitive material described above is referred to as sample 101.

(Preparation of Sample 102)

The sample was prepared in the same manner as performed for the sample 101 except that compound (23) was added to the 4th, 5th, 6th, 8th, 9th, 10th, 11th, 13th and 14th layers of the sample 101.

The samples 101 and 102 were exposed for 1/100 sec through, manufactured by Fuji Photo Film Co., Ltd., gelatin filter SC-39 and continuous wedge.

(Processing Procedure of Experiment 101)

The sample 101 after exposure was processed in the following manner.

(Processing Procedure)

| Step | Processing time | Processing temp. |
|---|---|---|
| Color development: | 3 min 15 sec | 38° C. |
| Bleaching: | 3 min 00 sec | 38° C. |
| Washing: | 30 sec | 24° C. |
| Fixing: | 3 min 00 sec | 38° C. |
| Washing (1): | 30 sec | 24° C. |
| Washing (2): | 30 sec | 24° C. |
| Stabilization: | 30 sec 38° C. | |
| Drying: | 4 min 20 sec | 55° C. |

The composition of the processing solution for use in each of the above steps is as follows:

| | (Unit: g) |
|---|---|
| (Color developer) | |
| Diethylenetriaminepentaacetic acid | 1.0 |
| 1-Hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethylamino)-2-methylaniline sulfate | 4.5 |
| Water | q.s. ad 1.0 L |
| pH (adjusted with potassium hydroxide and sulfuric acid) | 10.05. |
| (Bleaching solution) | |
| Ethylenediaminetetraacetic acid ferric ammonium trihydrate salt | 100.0 |
| Ethylenediaminetetraacetic acid disodium salt | 10.0 |
| 3-Mercapto-1,2,4-triazole | 0.03 |
| Ammonium bromide | 140.0 |
| Ammonium nitrate | 30.0 |
| Aq. ammonia (27%) | 6.5 mL |
| Water | q.s. ad 1.0 L |
| pH (adjusted with aq. ammonia and nitric acid) | 6.0. |

-continued

| | (Unit: g) |
|---|---|
| (Fixer) | |
| Ethylenediaminetetraacetic acid disodium salt | 0.5 |
| Ammonium sulfite | 20.0 |
| Aq. soln. of ammonium thiosulfate (700 g/L) | 295.0 mL |
| Acetic acid (90%) | 3.3 |
| Water | q.s. ad 1.0 L |
| pH (adjusted with aq. ammonia and nitric acid) | 6.7. |
| (Stabilizer) | |
| p-Nonylphenoxypolyglycidol (glycidol av. polymn. deg. 10) | 0.2 |
| Ethylenediaminetetraacetic acid | 0.05 |
| 1,2,4-Triazole | 1.3 |
| 1,4-Bis(1,2,4-triazol-1-ylmethyl)piperazine | 0.75 |
| Hydroxyacetic acid | 0.02 |
| Hydroxyethylcellulose (Daicel Chemical Industries, Ltd. HEC SP-2000) | 0.1 |
| 1,2-Benzoisothiazolin-3-one | 0.05 |
| Water | q.s. ad 1.0 L |
| pH | 8.5. |

(Processing Procedure of Experiment 102)

The same processing as in Experiment 101 was carried out except that the sample 102 was used in place of the sample 101.

(Processing Procedure of Experiments 103 to 110)

The same processing as in Experiment 101 was carried out except that only the color developer was changed as specified in Table 7.

The sensitivity of each of red-sensitive, green-sensitive and blue-sensitive layers was defined as the logarithm of inverse number of exposure intensity realizing minimum density+0.8 with respect to the cyan, magenta and yellow color image densities, respectively, and expressed by the difference from that of Experiment 101.

The graininess was estimated by determining the RMS granularity of each of cyan, magenta and yellow color images at a density of fog+0.8 and expressed by a relative value providing that the graininess of Experiment 100 was 100.

The storability was estimated by determining the difference between the fog density measured after allowing a raw sample to stand still in compulsory deterioration conditions of 50° C. 70% for 12 days and that measured without placing a raw sample in such compulsory deterioration conditions. The smaller the difference value, the preferably less the fog increase by aging.

TABLE 7

| Exp. No. | Sample No. | Color developer | Sensitivity Red* | Sensitivity Green* | Sensitivity Blue* | Graininess Red* | Graininess Green* | Graininess Blue* | Storability Red* | Storability Green* | Storability Blue* |
|---|---|---|---|---|---|---|---|---|---|---|---|
| 101 Comp. | 101 | | 0.00 | 0.00 | 0.00 | 100 | 100 | 100 | +0.07 | +0.08 | +0.09 |
| 102 Comp. | 102 (compd. (23) added in amt. of $15 \times 10^{-3}$ mol per mol of Ag) | Identical with color developer of Exp. 101 | +0.02 | +0.03 | +0.02 | 105 | 104 | 103 | +0.15 | +0.14 | +0.17 |
| 103 Inv. | 101 | Color developer of Exp. 101 having 2.5 g/L of compd. (11) added thereto | +0.06 | +0.08 | +0.08 | 99 | 101 | 101 | +0.06 | +0.08 | +0.08 |
| 104 Inv. | 101 | Color developer of Exp. 101 having 2.5 g/L of compd. (12) added thereto | +0.07 | +0.09 | +0.08 | 100 | 99 | 102 | +0.07 | +0.06 | +0.09 |
| 105 Inv. | 101 | Color developer of Exp. 101 having 2.5 g/L of compd. (13) added thereto | +0.06 | +0.07 | +0.06 | 100 | 99 | 101 | +0.07 | +0.07 | +0.08 |
| 106 Inv. | 101 | Color developer of Exp. 101 having 2.5 g/L of compd. (19) added thereto | +0.08 | +0.06 | +0.10 | 102 | 100 | 100 | +0.08 | +0.08 | +0.10 |
| 107 Inv. | 101 | Color developer of Exp. 101 having 2.5 g/L of compd. (23) added thereto | +0.10 | +0.11 | +0.11 | 100 | 101 | 99 | +0.08 | +0.06 | +0.07 |
| 108 Inv. | 101 | Color developer of Exp. 101 having 2.5 g/L of compd. (30) added thereto | +0.09 | +0.08 | +0.07 | 100 | 101 | 101 | +0.06 | +0.06 | +0.09 |
| 109 Inv. | 101 | Color developer of Exp. 101 having 2.5 g/L of compd. (33) added thereto | +0.07 | +0.08 | +0.09 | 100 | 99 | 100 | +0.08 | +0.09 | +0.08 |
| 110 Inv. | 101 | Color developer of Exp. 101 having 2.5 g/L of each of compds. (23) and (33) added thereto | +0.13 | +0.14 | +0.15 | 101 | 99 | 100 | +0.09 | +0.09 | +0.10 |

*Red: Red-sensitive layer, Green: Green-sensitive layer, Blue: Blue-sensitive layer As apparent from the above, by the process of the present invention, images can be obtained with high sensitivity without detriment to graininess. Thus, the process is excellent one. Further, it is apparent that the process of the present invention realizes excellent storability as compared with that of the sample obtained by addition in photosensitive material.

Example 2

(Experiment 201)

The sample 101 as used in Example 1 was exposed in the same manner as in Experiment 101 of Example 1 and was processed in the following manner.

| Step | Processing time | Processing temp. |
|---|---|---|
| Preprocessing: | 2 min 15 sec | 38° C. |
| Color development: | 3 min 15 sec | 38° C. |
| Bleaching: | 3 min 00 sec | 38° C. |
| Washing: | 30 sec | 24° C. |
| Fixing: | 3 min 00 sec | 38° C. |
| Washing (1): | 30 sec | 24° C. |
| Washing (2): | 30 sec | 24° C. |
| Stabilization: | 30 sec | 38° C. |
| Drying: | 4 min 20 sec | 55° C. |

| (Preprocessing solution) | (Unit: g) |
|---|---|
| Sodium hydrogen carbonate | 4.2 |
| Potassium carbonate | 38.2 |
| Potassium bromide | 1.4 |
| Potassium iodide | 1.5 mg |
| Water | q.s. ad 1.0 L |
| pH (adjusted with potassium hydroxide and sulfuric acid) | 10.05. |

The same color developer, bleaching solution, fixer and stabilizer as used in Experiment 101 of Example 1 were employed in this experiment as well.

(Processing Procedure of Experiments 202 to 208)

The same processing as in Experiment 201 was performed except that the preprocessing solution and color developer were changed as specified in Table 8.

The samples after processing were evaluated by measuring conducted in the same manner as in Example 1.

TABLE 8

| Exp. No. | Preprocessing solution | Color developer | Sensitivity Red* | Sensitivity Green* | Sensitivity Blue* | Graininess Red* | Graininess Green* | Graininess Blue* |
|---|---|---|---|---|---|---|---|---|
| 201 Comp. | | Identical with color developer of Exp. 101 | 0.00 | 0.00 | 0.00 | 100 | 100 | 100 |
| 202 Inv. | Preprocessing solution of Exp. 201 having 4.5 g/L of compd. (1) added thereto | Identical with color developer of Exp. 101 | +0.06 | +0.07 | +0.08 | 100 | 100 | 99 |
| 203 Inv. | Preprocessing solution of Exp. 201 having 4.5 g/L of compd. (8) added thereto | Color developer of Exp. 101 having 1.0 g/L of compd. (11) added thereto | +0.08 | +0.06 | +0.08 | 101 | 99 | 100 |
| 204 Inv. | Preprocessing solution of Exp. 201 having 4.5 g/L of compd. (15) added thereto | Color developer of Exp. 101 having 1.0 g/L of compd. (12) added thereto | +0.08 | +0.09 | +0.08 | 100 | 99 | 102 |
| 205 Inv. | Preprocessing solution of Exp. 201 having 4.5 g/L of compd. (23) added thereto | Color developer of Exp. 101 having 1.0 g/L of compd. (13) added thereto | +0.06 | +0.08 | +0.07 | 100 | 99 | 101 |
| 206 Inv. | Preprocessing solution of Exp. 201 having 4.5 g/L of compd. (29) added thereto | Color developer of Exp. 101 having 1.0 g/L of compd. (19) added thereto | +0.08 | +0.06 | +0.10 | 100 | 99 | 99 |
| 207 Inv. | Preprocessing solution of Exp. 201 having 4.5 g/L of compd. (15) added thereto | Color developer of Exp. 101 having 2.5 g/L of compd. (23) added thereto | +0.12 | +0.11 | +0.13 | 100 | 99 | 99 |
| 208 Inv. | Preprocessing solution of Exp. 201 having 4.5 g/L of compd. (23) added thereto | Color developer of Exp. 101 having 2.5 g/L of compd. (12) added thereto | +0.13 | +0.13 | +0.14 | 102 | 101 | 101 |

*Red: Red-sensitive layer, Green: Green-sensitive layer, Blue: Blue-sensitive layer It is apparent from Table 8 that the process conducted with the use of processing solution containing the compound of the present invention can realize sensitivity increase and thus is preferable.

What is claimed is:

1. A method of forming color image, comprising processing a silver halide color photosensitive material with a development processing solution containing a color developing agent, the silver halide color photosensitive material comprising a support and, superimposed thereon, a blue-sensitive layer unit composed of at least one silver halide emulsion layer, a green-sensitive layer unit composed of at least two silver halide emulsion layers, a red-sensitive layer unit composed of at least two silver halide emulsion layers and at least one non-light-sensitive layer, wherein the development processing solution or processing solution applied to the silver halide color photosensitive material before the use of the development processing solution contains compound (A), the compound (A) being a heterocyclic compound having three or more heteroatoms which when added, is capable of substantially enhancing the sensitivity of the silver halide color photosensitive material as compared with that exhibited when not added.

2. The method of forming color image according to claim 1, wherein the compound (A) is contained in the development processing solution containing a color developing agent.

3. The method of forming color image according to claim 1, wherein the compound (A) is contained in the processing solution in a proportion of 0.0001 to 100 g/liter.

4. The method of forming color image according to claim 1, wherein the compound (A) is contained in the processing solution in a proportion of 0.001 to 20 g/liter.

* * * * *